US007666297B2

(12) United States Patent
Lee et al.

(10) Patent No.: US 7,666,297 B2
(45) **Date of Patent: *Feb. 23, 2010**

(54) OXIDATIVE DESULFURIZATION AND DENITROGENATION OF PETROLEUM OILS

(75) Inventors: Fu-Ming Lee, Katy, TX (US); Tzong-Bin Lin, Chiayi (TW); Hsun-Yi Huang, Chiayi (TW); Jyh-Haur Hwang, Taichung County (TW); Hung-Chung Shen, Chiayi (TW); Karl Tze-Tang Chuang, Edmonton (CA)

(73) Assignee: CPC Corporation, Taiwan, Taipei (TW)

( * ) Notice: Subject to any disclaimer, the term of this patent is extended or adjusted under 35 U.S.C. 154(b) by 567 days.

This patent is subject to a terminal disclaimer.

(21) Appl. No.: 11/643,078

(22) Filed: Dec. 21, 2006

(65) Prior Publication Data

US 2007/0102323 A1 May 10, 2007

Related U.S. Application Data

(63) Continuation-in-part of application No. 10/996,402, filed on Nov. 23, 2004, now Pat. No. 7,276,152.

(51) Int. Cl.
*C10G 45/00* (2006.01)
*C10G 17/00* (2006.01)

(52) U.S. Cl. ..... 208/208 R; 208/219; 208/237; 208/240; 208/254 R; 549/528; 562/5

(58) Field of Classification Search ..... 208/208 R, 208/219, 237, 240, 254 R; 549/528; 562/5
See application file for complete search history.

(56) References Cited

U.S. PATENT DOCUMENTS 6,171,478 B1 1/2001 Cabrera et al.
6,277,271 B1 8/2001 Kocal
6,544,409 B2 4/2003 De Souza
6,596,914 B2 7/2003 Gore et al.
6,673,236 B2 1/2004 Stanciulescu et al.
7,179,368 B2 2/2007 Rablon et al.
7,276,152 B2 * 10/2007 Lin et al. ..... 208/219
2003/0094400 A1 5/2003 Levy et al.
2004/0178122 A1 9/2004 Karas et al.

OTHER PUBLICATIONS

Lu, Tze-Fong et al., "Desulfurization of FCC Diesel Using H2O2 Organic Acids," J. Uni. of Petroleum, China 25(3), p. 26-29, Jun. 2001.

F.M. Collins et al., "Oxidative desulfurization of oils via hydrogen peroxide and heteropolyanion catalysis," J. of Molecular Catalysis A: Chemical 117 (1997) p. 397-403.

* cited by examiner

*Primary Examiner*—In Suk Bullock
*Assistant Examiner*—Prem C. Singh
(74) *Attorney, Agent, or Firm*—Cascio Schmoyer & Zervas

(57) ABSTRACT

An improved oxidative process that employ a robust, non-aqueous, and oil-soluble organic peroxide oxidant for effective desulfurization and denitrogenation of hydrocarbons including petroleum fuels, hydrotreated vacuum gas oil (VGO), non-hydrotreated VGO, petroleum crude oil, synthetic crude oil from oil sand, and residual oil. Even at low concentrations and without the assistance of catalysts, the non-aqueous organic peroxide oxidant is extremely active and fast in oxidizing the sulfur and nitrogen compounds in the hydrocarbon feedstocks. Furthermore, the process generates a valuable organic acid by-product that is also used internally as the extractive solvent for effective removal of the oxidized sulfur and nitrogen from the hydrocarbons without the need of a final adsorption step. Novel process steps are also disclosed to substantially prevent yield loss in the oxidative process.

52 Claims, 6 Drawing Sheets

OXIDATIVE DESULFURIZATION AND DENITROGENATION OF PETROLEUM OILS

REFERENCE TO RELATED APPLICATION

This is a continuation-in-part application of U.S. patent application Ser. No. 10/996,402 which was filed on Nov. 23, 2004, now U.S. Pat. No. 7,276,152.

FIELD OF THE INVENTION

The present invention is directed to an improved oxidative desulfurization process that removes organic sulfur and nitrogen compounds from petroleum oils using non-aqueous oxidants. The process does not require oxidation catalysts nor the use of complicated adsorption techniques for final product polishing that are associated with the prior art. The novel process is suitable for treating heavy hydrocarbon oils, including hydrotreated and non-hydrotreated vacuum gas oil, atmospheric residual oil, crude oil, and synthetic crude oil from oil sand. The process can be employed with transportation fuel streams to produce gasoline, jet fuel, and diesel, as well as with intermediate refinery streams including light cycle oil.

BACKGROUND OF THE INVENTION

Stringent U.S. environmental regulations require that the level of sulfur in gasoline be reduced by 90% from the current 300 ppm to 30 ppm and those in diesel be reduced by 97% from the current 500 ppm to 15 ppm or even lower. Hydrotreating is the most common method of removing organic sulfur and nitrogen compounds from petroleum fractions. In hydrotreating, oil and hydrogen are fed to a fixed bed reactor that is packed with a hydrodesulfurization (HDS) catalyst. The HDS operating temperature and pressure typically range from 300-400° C. and from 35 to 170 atm, respectively. The more difficult the sulfur removal needed, e.g., the higher the level of sulfur reduction, the more stringent the HDS operating temperatures and pressures become. In this regard, severe hydrotreating of gasoline feedstock to achieve low sulfur levels will saturate a significant portion of the olefins in the gasoline thereby substantially lowering the octane number. To minimize the octane loss, state of the art hydrotreating catalysts can isomerize the paraffins that are generated by olefin saturation. In a similar vein, it is expected that more robust catalysts must be developed and efficient process modifications implemented in order to remove the most refractory sulfur compounds. Most refiners have revamped their existing hydrotreating facilities and/or introduced new hydrotreating techniques in anticipation of these challenges as they comply with the new U.S. guidelines.

In recent years, industry has sought to develop less expensive desulfurization alternatives to hydrotreating. It is known that contacting a petroleum distillate to an oxidant converts sulfur and nitrogen compounds in the distillate into sulfones (or sulfoxides) and organic nitrogen oxides, respectively. These polar organic oxides can be removed from the distillate by solvent extraction and/or adsorption.

The oxidants currently used in oxidative desulfurization include, for example, peroxy organic acids, catalyzed hydroperoxides and inorganic peroxy acids. Almost all peroxy organic acids are derived by oxidation of organic acids with hydrogen peroxide. For example, EP 1004576 A1 to Druitte discloses a process for producing peracetic acid (PAA) by reacting hydrogen peroxide and acetic acid (AA) in an aqueous reaction medium.

U.S. Pat. No. 6,160,193 to Gore discloses a method for removing sulfur and nitrogen compounds from petroleum distillates, such as light gas oil (diesel) by oxidation with a selective oxidant. The oxidants are divided into three categories: (1) hydrogen peroxide based oxidants, (2) ozone based oxidants, and (3) air or oxygen based oxidants. The preferred oxidant is PAA that is formed by oxidizing glacial AA with 30-50% aqueous hydrogen peroxide. Since the peroxide is in the aqueous phase, a phase transfer agent is required to carry the peroxide from the aqueous phase to the oil phase where it oxidizes the sulfur and nitrogen compounds. The phase transfer, which is the rate-limiting step, significantly slows down the reaction rates. In this case, AA is the phase transfer agent for the oxidation of the sulfur and nitrogen compounds in the light gas oil. A small but not insignificant amount of AA remains in the oil phase in the reactor effluent.

Another disadvantage of using the aqueous oxidant disclosed in U.S. Pat. No. 6,160,193 is that the presence of water in the reactor effluent prevents phase separation of oil from the aqueous acid when the oil feed is vacuum gas oil, atmospheric residual oil, crude oil, or other heavy hydrocarbons. Complicating matters is the fact that the sulfones generated in the oxidation reactor also function as surfactants that inhibit phase separation. The spent AA, which is equivalent to 7 to 10 wt % of the oil feed, cannot be effectively removed from the oil, treated, and recycled without phase separation. In this regard, it has been demonstrated that an aqueous oxidant when mixed with virgin crude oil forms a very stable emulsified liquid mixture which does not readily separate into its two different phases. The aqueous oxidant tested consisted of hydrogen peroxide, water, as well as an organic acid which serves as the phase transfer agent. The presence of water can also cause a significant portion of the sulfones and organic oxides to precipitate from the reactor effluent. Indeed, solids may form at critical stages in the process thereby causing the valves, pumps, and even the adsorbent bed to malfunction. U.S. Pat. No. 6,160,193 does not appear to recognize the importance of the solid precipitation problem, which certainly occurs when the distillate contains more than 500 ppm sulfur and nitrogen compounds.

The specific solvents used to extract sulfones from the distillate phase in the process disclosed in U.S. Pat. No. 6,160,193 also tend to extract appreciable amounts of oil along with the sulfones and organic nitrogen oxides. In this regard, the prior art has disclosed many solvents for the sulfones extraction, including dimethyl sulfoxide (DMSO), formic acid, nitromethane, dimethyl formamide (DMF), trimethyl phosphate, and methanol. See, for example, U.S. Pat. No. 6,160,193 to Gore, U.S. Pat. No. 6,274,785 to Gore, U.S. Pat. No. 6,402,940 to Rappas, U.S. Pat. No. 6,406,616 to Rappas et al., and EP 0565324 A1 to Aida. However, none of these solvents has proven to be cost effective in removing sulfones from the oil.

U.S. Pat. No. 6,596,914 to Gore discloses the use of an aqueous acetic acid (AA) solvent which contains 1 to 5 wt % water to extract of sulfur oxides. In practice, it is difficult to remove (or recover) the AA because AA and water form an azeotrope consisting of 3 wt % AA and 97 wt % water. As a result, it is necessary to incorporate azeotropic distillation, liquid-liquid extraction or other operations into the process to recover the AA from an aqueous waste stream. In addition, separation equipment that is exposed to aqueous AA solvents must be made of special alloys given the corrosive nature of the solvents especially at elevated temperatures.

U.S. Pat. No. 6,402,940 to Rappas describes a process for desulfurizing fuels such as diesel oil to achieve a sulfur level of 2 to 15 ppm. The oxidant is hydrogen peroxide in a formic acid solution with no more than 25 wt % water. Since hydrogen peroxide is in the aqueous phase, the formic acid functions as the phase transfer agent that transfers the hydrogen peroxide to the oil phase. Given that formic acid is a more efficient phase transfer agent than acetic acid, the oxidation reaction rate is faster under formic acid. Nevertheless, phase transfer remains the rate-limiting step. A major drawback of the process relates to the spent acid recovery system. As described in the patent, the spent acid, which contains formic acid, water, sulfones, and trace amounts of diesel, is first fed to a flash distillation vessel to strip out the formic acid and water. The formic acid and water are then fed to an azeotropic distillation column. In this process, water is derived from oxidation reactions and from the aqueous hydrogen peroxide feed. Water must be removed from the spent formic acid stream in order to maintain the water balance in the process. It is known that formic acid and water form an azeotrope containing 77.5 wt % formic acid and 22.5 wt % water. However, according to the disclosed process, feed to the azeotropic distillation column contains more than 77.5 wt % formic acid. Consequently, the column could produce essentially pure formic acid in the overhead stream and about 77.5 wt % formic acid (but not pure water) in the bottom stream. In light of this, it would be impossible to remove water from the spent formic acid and it appears that the disclosed process is inoperable.

The presence of water in the reactor effluent also causes a significant portion of the sulfones and organic oxides to precipitate from the liquid phases and disrupt the process. As mentioned previously, water in the system also renders the process unsuitable for desulfurizing heavy hydrocarbons, such as vacuum gas oil, atmospheric resid, and crude oil, due to the difficulties in phase separation between oil and the aqueous acid.

A non-aqueous, oxidative desulfurization method for petroleum fuels was described in U.S. patent application 2004/0178122 to Karas et al. whereby fuel streams are exposed to an organic hydroperoxide oxidant, such as t-butylhydroperoxide (TBHP), in the presence of a titanium-containing silicon oxide catalyst. Due to the limited reactivity of the oxidant, the oxidative desulfurization reaction must to be catalyzed when operating at a reasonable temperature (80° C. according to Example 3). To slowdown the irreversible decay of the catalyst, the oil feed has to be pretreated to reduce the nitrogen content in the feed by adsorption or liquid-liquid extraction to very low levels (7 ppm according to Example 3). As is apparent, the process is restricted to handling light oil feeds with low nitrogen and sulfur contents. The necessity of employing pretreatment and catalysts also adds to the complexity and costs of the process.

Each of U.S. Pat. No. 6,596,914 to Gore, U.S. Pat. No. 6,406,616 to Rappas, U.S. Pat. No. 6,402,940 to Rappas, U.S. Pat. No. 6,274,785 to Gore, U.S. Pat. No. 6,160,193 to Gore, and U.S. patent application 2004/0178122 to Karas et al. teach to the use of solid adsorption to remove final traces of sulfones to produce ultra-low sulfur fuels. For example, U.S. Pat. No. 6,402,940 describes the use of non-activated alumina which has a relatively high surface area to remove sulfones. The non-activated alumina, however, must be regenerated following use. Similarly, U.S. Pat. No. 6,160,193 parenthetically discloses the use of silica gel and clay filter for removing sulfones.

The removal of sulfones by adsorption is typically a batch process, with respect to the adsorbents used, that encompasses an operation cycle and a separate regeneration cycle. The two cycles have flow sequences which are quite different from each other. In particular, the regeneration procedure entails numerous line and valve switches to direct different fluids in and out of the adsorption column and to reverse the flow directions at various stages in the regeneration cycle. Adding to the complexity is the fact that solid adsorbents normally have very limited sulfones loading and must be frequently regenerated. Furthermore, the adsorbent life, which is a critical factor to the success of this process, is uncertain and requires extensive evaluation. Although adsorption method is very selective in removing sulfones to produce ultra-low sulfur oil, its high capital investment and operating costs, limited capacity, and uncertainty in the adsorbent life, makes this method undesirable for commercial operations. The present invention has effectively eliminated the need of adsorption for final product polishing.

It is known that oxidative desulfurization can easily oxidize and remove thiophenic sulfur compounds, which cannot be readily treated by HDS due to the stereo hindrance effect around the sulfur atom in the molecules. In this regard, the order of the activities of representative thiophenic compounds in response to HDS treatment is as follows: DBT (dibenzothiophene)>4 MDBT (4-methyl dibenzothiophene) >4,6 DMDBT (4,6-dimethyl dibenzothiophene). See, Ind Eng Chem Res, 33, pp 2975-88 (1994). In contrast, it has been reported that the order of activity of thiophenic compounds in response to oxidative treatment is just the opposite, namely: 4,6 DMDBT>4 MDBT>DBT. See, Energy Fuels, 14, pp 1232-39 (2000). These observations suggest that oxidative desulfurization may be effective in removing even the most difficult residual sulfurs from hydrotreated oils to yield ultra-low sulfur products.

The concept of hydrotreating a hydrocarbon feed containing sulfur compounds prior to oxidation to facilitate the removal of hard-to-hydrotreat thiophenic compounds was described by Collins in Journal of Molecular Catalysis A: Chemical 117(1997), 397-403. More recently, U.S. Pat. No. 6,171,478 to Cabrera et al. (assigned to UOP LLC) disclosed a desulfurization process for hydrocarbon oil that includes HDS treatment followed by oxidation with an oxidizing agent. U.S. Pat. No. 6,277,271 to Kocal (assigned to UOP LLC) describes a similar process which includes the step of recycling the oxidized sulfur compounds to an upstream HDS reactor in order to allegedly increase hydrocarbon recovery. In particular, without the benefit of any experimental data, the patent asserts that sulfur oxides are easily convertible to $H_2S$ gas in the HDS unit. However, this assumption is dubious as explained herein.

U.S. patent application 2003/0094400 to Levy et al. describes a process for removing sulfur from hydrocarbons streams whereby organic sulfur is first oxidized into oxidized sulfur in the hydrocarbon stream which is then exposed to hydrogen to reduce the sulfur to $H_2S$ to yield a hydrocarbon stream which is substantially free of sulfur. The process uses an oxidation unit that is positioned in front of an HDS unit. Levy et al. states that any suitable oxidative method can be employed to oxidize the sulfur compounds including the use of aqueous oxidants that contain hydrogen peroxide and organic acids, e.g., formic acid. Levy et al. apparently failed to recognize that their own experimental evidence did not substantiate their position that it was easier to reduce the oxidized sulfur compounds to $H_2S$ and the corresponding hydrocarbons than it was to reduce the unoxidized sulfur compounds. Example 2 of Levy et al. provides data relating light atmospheric gas oil (diesel) that was used as a reactant feed. The diesel, which contained 435 ppm sulfur, was oxidized using a hydrogen peroxide aqueous solution in the presence of a formic acid catalyst (a phase transfer agent). The resulting oxidized diesel contained 320 ppm sulfur. Both the original diesel and the oxidized diesel were hydrotreated under identical conditions. The comparative conversion results from Levy et al. are summarized as follows:

| Sulfur content in unoxidized diesel feed: | 435 ppm |
|---|---|
| Sulfur content in oxidized diesel feed: | 320 ppm |

| | Sulfur in product (ppm) | | % Sulfur Removed | |
|---|---|---|---|---|
| Temp (° C.) | Oxidized | Unoxidized | Oxidized | Unoxidized |
| 250 | 103 | 198 | 67.8 | 54.5 |
| 300 | 55 | 60 | 82.8 | 86.2 |

The data show no significant difference in HDS results between the unoxidized and oxidized diesel feeds, especially at the HDS temperature of 300° C., which is more comparable to commercial HDS conditions for diesel feed. Therefore, Levy et al. appears to contradict the touted benefits that oxidizing the HDS feed would improve sulfur removal in the HDS unit or that recycling the oxidized sulfur compounds to the HDS unit would improve the oil recovery of down-stream oxidation process as is asserted in U.S. Pat. No. 6,277,271.

The lack of significant sulfur removal enhancement may be due to the fact that under certain HDS conditions some of the oxidized sulfur compounds are actually reduced to the original sulfur compounds instead of being reduced to the corresponding hydrocarbon compounds with a concomitant release of $H_2S$ in the HDS unit. Indeed this conclusion can be extrapolated from the experimental data disclosed in Example 1 of Levy et al. which describes oxidation of sulfur compounds followed by hydrotreatment under different reactor conditions. In particular, solutions of dibenzothiophene (DBT) sulfone (a model compound for the oxidized sulfur compounds) that contained 250 ppm sulfur in phenyl hexane solvent were used as the "feed." The data in Example 1 purportedly showed that the oxidized sulfur compounds were all converted under the reactor conditions tested.

Subsequently, applicants of the present invention discovered that, depending upon the HDS conditions, DBT sulfone could be either totally hydrotreated to produce biphenyl (a model compound corresponding to totally desulfurized DBT sulfone) or partially hydrotreated to produce a mixture containing DBT (a sulfur compound corresponding to DBT sulfone before oxidation) and biphenyl. Therefore, in order to improve the recovery of oxidative desulfurization process through recycling an oil stream containing the oxidized sulfur compounds (mainly sulfones) to an upstream HDS unit, the operating conditions of the HDS unit must be properly adjusted to assure that the sulfones are converted to the corresponding hydrocarbon compounds and $H_2S$ and not to the original sulfur compounds that were present prior to oxidation. These original sulfur compounds can be regarded as "hard-to-hydrotreat" sulfur-type compounds, which have gone through the same HDS unit without being converted; they will most likely just continue to accumulate within the loop between the HDS and the oxidation step. The presence of these "hard-to-hydrotreat" sulfur compounds renders inoperable the concept of recycling oxidized sulfur compounds to an upstream HDS reactor in order to enhance hydrocarbon recovery as alleged in U.S. Pat. No. 6,277,271.

The recycling scheme disclosed in U.S. Pat. No. 6,277,271 uses hydrogen peroxide in aqueous acetic acid (or other aqueous carboxylic acids) as a preferred oxidant. This oxidant however is unsuitable for use with heavy hydrocarbon oil, such vacuum gas oil (VGO). The reason is that the sulfones in the oxidized VGO will emulsify the heavy oil phase with the aqueous phase thereby rendering phase separation extremely difficult when endeavoring to recover the oxidized VGO from the spent acid. Ironically, the only illustrative embodiment in the patent used VGO as the feed. Furthermore, the same illustrative embodiment teaches using severe HDS conditions for VGO with pressures of 1700 psig, temperatures up to 740° F. and hydrogen circulation of 5000 SCFB. At such extreme conditions, it is unrealistic to expect sulfur reduction in VGO of from 2 wt % (20,000 ppm) to 500 ppm. In fact, hydrotreated VGO with 500 ppm sulfur needs no oxidative desulfurization to further reduce sulfur before being fed to a fluid catalytic cracking (FCC) unit because with such a low sulfur (and low nitrogen) feedstock, the FCC unit can generate sufficiently clean gas products and FCC naphtha that require no post desulfurization treatment. In addition, it is unrealistic to assert that sulfur in the hydrotreated VGO can be reduced from 500 ppm to 50 ppm by the oxidation scheme described in the illustrative embodiment of the patent. Indeed, investigations have revealed that certain sulfur species (>50 ppm) in the hydrotreated VGO cannot be removed by the oxidation scheme.

A still further problem associated with the illustrative embodiment of U. S. Pat. No. 6,277,271 is the use of acetonitrile as the sulfur oxide extraction solvent. In fact, all the extractive solvents disclosed including acetonitrile, dimethyl formamide (DMF) and sulfolane are not suitable for sulfur oxide removal. The performance of acetonitrile and DMF for sulfur oxides extraction from an oxidized FCC diesel was reported in "Desulfurization of FCC Diesel Using $H_2O_2$-Organic Acids", J. of University of Petroleum, China, 25(3), p. 26, Jun. 2001. Specifically, FCC diesel containing 0.8 wt % sulfur was oxidized with 30% aqueous $H_2O_2$ in the presence of formic acid. The oxidized sulfur compounds were extracted from the diesel by liquid-liquid extraction using several polar solvents including acetonitrile and DMF under the following conditions: 5% water in the solvents, 1:2 solvent-to-diesel ratio, and 10 minutes extraction time, the extraction results are summarized as follows:

| Solvent | Sulfur in Recovered Oil (%) | Sulfur Reduction (%) | Oil Recovery (%) |
|---|---|---|---|
| Acetonitrile | 0.38 | 55.4 | 79.5 |
| DMF | 0.27 | 68.5 | 72.0 |

The data suggest that the solubility of oil in the solvents (each of which contained 5% water) was very high and as a result the oil recovery (in the oil phase) was only 70 to 80% in the one-stage extraction. Based on these results, it is expected that using the same solvents in dry form in a multi-stage extraction for 90% sulfur reduction (that is, from 500 to 50 ppm) would result in an even lower oil recovery since dry solvents have correspondingly even higher solubilities for oil as compared to the same solvents containing water. This means a bulk quantity of oil (equivalent to more than 30% of the oxidized oil) has to be recycled with the sulfur oxides to the HDS unit in order to reduce the oil loss in the process described in the patent.

SUMMARY OF THE INVENTION

The present invention is based, in part, on the development of a robust, versatile, non-aqueous, and oil-soluble organic peroxide oxidant that is particularly suited for oxidative desulfurization and denitrogenation of hydrocarbon feedstocks including petroleum fuels, hydrotreated and unhydrotreated VGO, petroleum crude oil, and synthetic crude oil from oil sand. Even at low concentrations and without the presence of any catalysts (either heterogeneous or homogeneous), the non-aqueous organic peroxide oxidant is extremely active and fast in oxidizing the sulfur and nitrogen compounds in the hydrocarbon feedstocks. Consequently, the oxidation reactions that employ the non-aqueous organic peroxide oxidant take place at substantially lower temperatures and shorter residence times than any other oxidative desulfurization and denitrogenation processes. As a result, a higher percentage of the valuable non-sulfur and non-nitrogen containing components in the hydrocarbon feedstock are more likely to be preserved with the inventive process.

A feature of the invention is that desulfurization and denitrogenation occur in a single phase non-aqueous environment so that no phase transfer of the oxidant is required. Moreover, there is no measurable amount of water in the system which would otherwise cause unexpected solids precipitation; indeed, the non-aqueous medium of the oxidant is also an excellent solvent for sulfones and organic nitrogen oxides that are produced. Furthermore, no phase separation is required for recycling the spent acid, which is the phase transfer agent used in prior art oxidative desulfurization methods. Another benefit of the novel process is that it generates a recoverable organic acid, i.e., acetic acid (AA), as a valuable by-product.

The invention is further based, in part, on the unexpected discovery that essentially all sulfones can be removed from oxidized light hydrocarbons, such as oxidized diesel, by liquid-liquid extraction whereby in situ generated non-aqueous (water-free) AA is used as the extractive solvent to produce an ultra-low sulfur fuel product that meets the new environmental requirements. The invention eliminates the need for a complicated and troublesome adsorption step, which is typically required in prior art oxidative desulfurization processes. In comparison to the use of aqueous AA to extract sulfones in the process disclosed in U. S. Pat. No. 6,596,914 to Gore et al, which is incorporated herein, the present invention's employment of non-aqueous AA as the extractive solvent avoids the difficult operational problems associated with the azeotropic formation of AA and water and the corrosion caused by aqueous AA. The novel oxidative desulfurization process is quite versatile and is capable of treating heavy hydrocarbons, including hydrotreated and non-hydrotreated VGO, residual oil, and crude oils.

DETAILED DESCRIPTION OF THE PREFERRED EMBODIMENTS

Figure 1A:
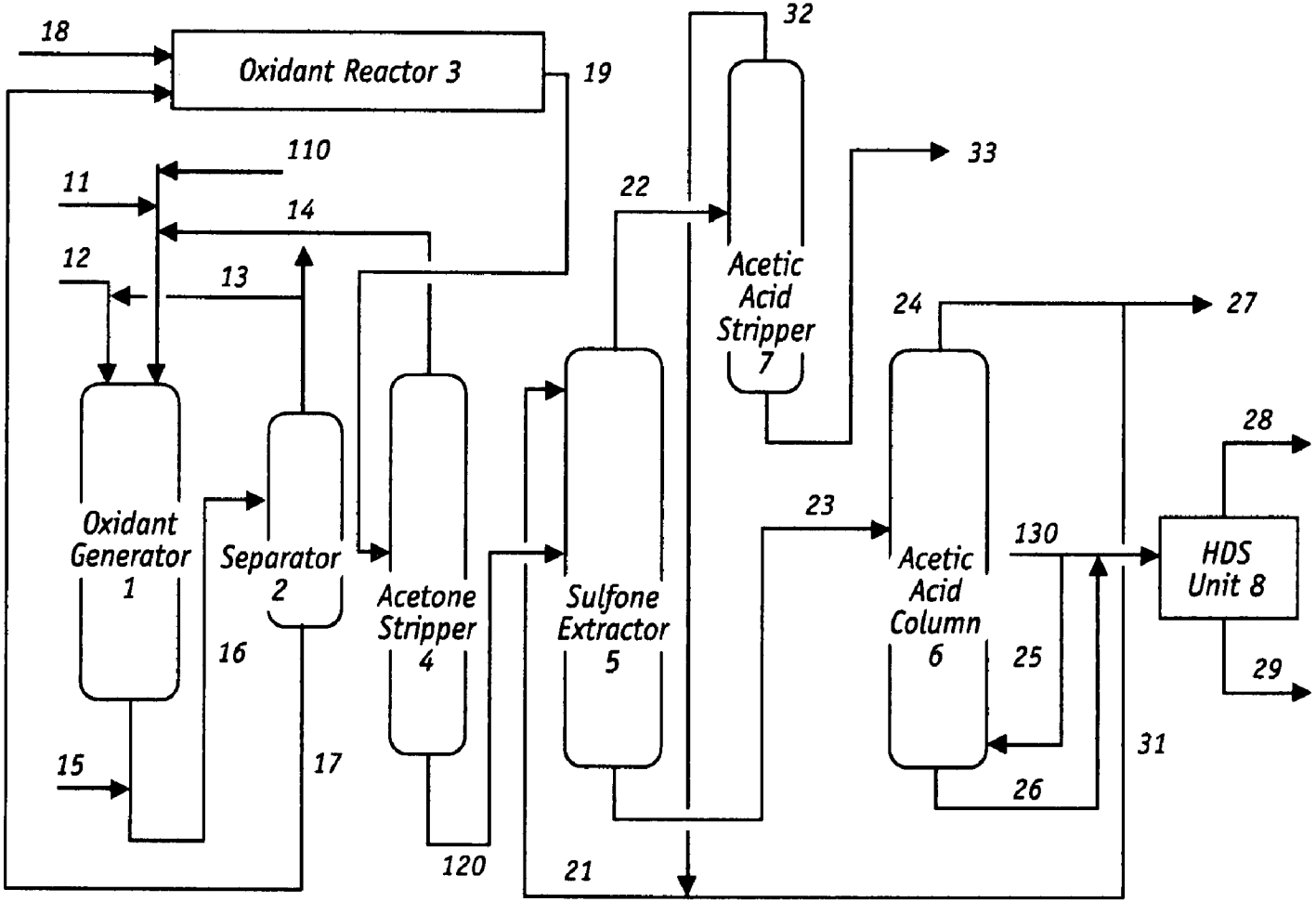
FIGS. 1A and 1B are schematic flow sheets of desulfurization and denitrogenation processes that are employed for light hydrocarbons and heavy hydrocarbons, respectively.

The present invention is directed to an oxidative desulfurization and denitrogenation process for removing sulfur and nitrogen compounds from hydrocarbon feedstocks that include, for instance, gasoline, diesel, vacuum gas oil, atmospheric residual oil and crude oil. The process employs a non-aqueous, oil-soluble peroxide oxidant to generate sulfones and organic nitrogen oxides that are extracted preferably with low-boiling point solvents.

Preparation of Peroxide Oxidant

The desulfurization and denitrogenation process of the present invention employs a peroxide oxidant having the formula RCOOOH where R represents hydrogen or the alkyl group. Preferably, the alkyl group is a lower alkyl which includes both straight—and branched chain alkyl groups having a total of 1 through 6 carbons, preferably 1 through 4 carbons, and includes primary, secondary, and tertiary alkyl groups. Typical lower alkyls include, for example, methyl, ethyl, n-propyl, isopropyl, n-butyl, and t-butyl. Most preferably, R is methyl. The desulfurization and denitrogenation process can produce gasoline that contains 30 ppm sulfur or less, diesel that contains 15 ppm sulfur or less, and hydrotreated VGO that contains 600 ppm sulfur or less which can substantially improved the performance of a downstream fluidized catalytic cracking (FCC) unit.

Peroxides having the formula RCOOOH where R represents hydrogen or an alkyl group are commercially available. Furthermore, methods for synthesizing the peroxides are known. For example, peracetic acid can be made by oxidizing acetic acid with hydrogen peroxide in aqueous solution and then removing essentially all the water from the oxidant by heating or other feasible means. The term "a non-aqueous, oil-soluble peroxide oxidant" or "non-aqueous peroxide oxidant" refers a peroxide of the above formula which is dissolved in an organic solvent or in a hydrocarbon feedstock. No significant amount of water is present in the organic solvent or hydrocarbon feedstock which would create an aqueous phase with a portion of the peroxide dissolved therein. In other words, the non-aqueous peroxide oxidant is in a single, organic-phase.

A novel and preferred method of synthesizing the peroxide oxidants uses an organoiron catalyst which promotes the oxidation of aldehydes by molecular oxygen to form a peroxide according to the following reaction: $RCHO + O_2 \rightarrow RCOOOH$ where R represents hydrogen or an alkyl group, as described above.

The reaction is carried out under mild temperatures and pressures in a non-aqueous medium which is preferably an organic solvent that is non-reactive and that is a good solvent for the sulfones and organic nitrogen oxides that are formed in the oxidative process. The latter helps prevent solid precipitation in the reactor or other components in the process. The organic solvent is preferably also completely miscible with the hydrocarbon feedstock, e.g., oils. Particularly preferred organic solvents are ketones ($R_2O$). Typically, the amount of organic solvent employed is such that the weight ratio of RCHO reactant to organic solvent ($R_2O$) ranges from about 1:10 to 10:1 and preferably from about 1:1 to 1:4.

The organoiron catalysts are homogenous catalysts that are soluble in organic solvents and catalyze the oxidation of aldehydes by molecular oxygen to form a peroxide. Preferred organoiron catalysts include, for example, Fe(III) acetylacetonate (FeAA), Fe(III) ethylhexanoate (FeEHO), ferrocenyl methyl ketone (FeMK), and mixtures thereof. These are all commercially available. Typically, the catalyst concentration ranges from about 0.1 to 10,000 ppm (Fe) and preferably from about 0.1 to 10 ppm (Fe).

As an example of preparing PAA, acetaldehyde ($CH_3CHO$) is mixed in acetone ($CH_3OCH_3$) and the mixture contacted with oxygen to produce PAA ($CH_3COOOH$) through an oxidation reaction promoted by one or more of the organoiron catalysts. The organoiron catalysts were found to catalyze oxidation of aldehydes directly to the corresponding peroxy organic acids with molecular oxygen at very mild reaction conditions. For acetaldehyde, the reaction temperature and pressure were typically from 0 to 100° C. and from 0 to 200 psig, respectively, and preferably, from 40 to 60° C. and from 50 to 150 psig, respectively. The impurities, mainly AA, can be minimized by designing the process to yield lower acetaldehyde conversions, i.e., by employing a lower PAA concentration in oxidant. It was unexpectedly discovered that the peroxide oxidant was so robust that oxidative desulfurization of the oils occurs even at low PAA concentrations. Minor amounts of AA and the unconverted acetaldehyde were found to have no effect on the subsequent oxidation reactions of sulfur and nitrogen in the oil feed.

Oxidation of Sulfur and Nitrogen Compounds

In oxidizing sulfur and nitrogen compounds that are present in hydrocarbon feedstock, the feedstock reacts with the peroxide oxidant in an oxidation reactor operating at low temperatures and pressures. The organic sulfur compounds are converted to sulfones and the organic nitrogen compounds are converted to nitrogen oxides in a single oil phase. When the feedstock is commercial diesel, essentially all the sulfur and nitrogen compounds will have to be oxidized in order to achieve a sulfur level of 15 ppm or less in the diesel product. For higher sulfur and nitrogen containing feeds, such as light cycle oil, hydrotreated and unhydrotreated VGO, atmospheric residual oil, and crude oil, partial oxidation of sulfur and/or nitrogen may be desirable for economic reasons.

When the peroxide oxidant is PAA, the oxidation reaction produces AA as a by-product as the PAA molecule releases its activated oxygen atom in the reaction. Based on experiments conducted with a commercial diesel feed containing 500 ppm sulfur, it has been shown that in the oxidation process the PAA generates 3750 ppm (0.375 wt %) AA. This concentration of AA is substantially below its solubility limit in diesel or heavier hydrocarbons, which is approximately 2 wt % or more at room temperature. As a result, no phase separation is observed. In the case where the concentration of AA is higher than the solubility limit, the solvent, e.g., acetone, in the initial oxidant composition also helps prevent phase separation, since the solvent is typically miscible in both the oil and AA. The oxidation reactions typically are carried out at a temperature and pressure of from about 0 to 150° C. and from about 0 to 200 psig, respectively, preferably, from about 20 to 80° C. and from about 0 to 50 psig, respectively.

Product Purification and Recovery

Following the oxidation reaction, the sulfones and organic nitrogen oxides are preferably removed from the product by solvent extraction. Suitable extraction solvents are preferably low boiling solvents with high affinity to the sulfones and organic nitrogen oxides. Preferred extraction solvents include, for example, organic acids, ammonia, and alcohols. A particularly preferred solvent is acetic acid (AA). A preferred source of the AA is generated in the oxidation reactor as a by-product of the oxidation reaction. This AA can be an excellent solvent for extracting the sulfones and nitrogen oxides from the oxidized feedstock. However, the AA used for the sulfone extraction has to be essentially water-free in order to prevent solid precipitations, corrosion, and the formation of AA/water azeotrope in this process. Aqueous acetic acid (AA containing 1 to 5 wt % water) disclosed as the sulfone extraction solvent in U.S. Pat. No. 6,596,914 to Gore is entirely unsuitable for this process. Moreover, in addition to supplying the extract solvent for sulfone and nitrogen oxides removal, the AA generated from the process is a valuable and important by-product for chemical applications.

Process Flow for Light Hydrocarbon Feedstock

FIG. 1A is a flow diagram of an oxidative desulfurization and denitrogenation process for treating light hydrocarbons, such as treated light gas oil (TLGO), which is a diesel fuel. The process employs an oxidant generator 1, separator 2, oxidation reactor 3, acetone stripper 4, sulfone extractor 5, acetic acid column 6, acetic acid stripper 7, and hydrodesulfurization (HDS) Unit 8 as the major components. It should be noted that the "oxidant generator" is where the oxidant, such as PAA, is made whereas the "oxidation reactor" is where the sulfur compounds and the nitrogen compounds in the oil feed are oxidized by the oxidant. The non-essential details of the process, such as the location of pumps, valves, heat-exchanger, heaters, coolers, compressors, vacuum equipment, and instrumentations are omitted for clarity. In this example, the peroxide oxidant is PAA which is prepared by reacting acetylaldehyde with oxygen in acetone. The reaction is catalyzed by iron (III) acetylacetonate (FeAA).

Referring to FIG. 1A, a homogeneous solution of iron (III) acetylacetonate (FeAA), fresh acetaldehyde, and recycled acetone and acetaldehyde from the overhead of acetone stripper 4 are introduced into oxidant generator 1 via lines 110, 11, and 14, respectively. Oxygen is introduced separately into oxidant generator 1 via line 12. Oxidant generator 1 can be any vessel suitable for continuously contacting acetaldehyde, oxygen, and the FeAA catalyst under controlled reaction conditions to oxidize acetaldehyde into PAA. Oxidant generator 1 is preferably a simple column that is packed with any suitable packing or trays or it can be a tubular reactor that is packed with static mixers. The liquid containing acetaldehyde and the homogeneous catalyst is mixed with the oxygen gas co-currently at temperatures ranging from 40 to 60° C. and pressures ranging from 50 to 150 psig. Operating conditions for the reaction are maintained within these limits in order to yield a reactor effluent that contains 0 to 30 wt % PAA and preferably 5 to 25 wt % PAA. The specific concentration of PAA depends on the requirements of the down-stream oxidation reactor 3. Producing the required PAA concentration in the reactor effluent without generating AA and carbon dioxide in oxidant generator 1 is preferred. The concentration of the catalyst is typically maintained at between 0 to 100 ppm (Fe) and preferably 5 to 10 ppm (Fe). A sufficient amount of fresh acetone, acetic acid, or the light hydrocarbon feed is added to the effluent from oxidant generator 1 through line 15 to adjust the PAA concentration and the combined stream is fed to the separator 2 via line 16 where the light gases, such as oxygen, are removed as the overhead stream from the liquid mixture. A portion of the overhead stream is recycled to oxidant generator 1 via line 13.

The gas-free oxidant from separator 2 is fed to oxidation reactor 3 via line 17 to oxidize the light hydrocarbon feed, which is introduced to oxidation reactor 3 through line 18. Since the PAA in acetone is completely miscible in the oil, no phase transfer is required and the PAA reacts quickly with the sulfur and nitrogen compounds in the oil even at low PAA concentrations. The reaction temperature is typically from 0 to 100° C. and preferably from 30 to 50° C. Oxidation reactor 3 can be any suitable vessel that brings the oil and the liquid oxidant into continuous contact. Oxidation reactor 3 is preferably a tubular reactor that is packed with static mixers to provide the requisite mixing and reaction residence time. The tubular reactor can be made from a pipe which is simpler and less expensive than other designs. Pipes are also more space efficient since they can be folded horizontally or vertically.

Oxidation of the sulfur and/or nitrogen compounds in the oil to yield desired levels takes place in oxidation reactor 3; it is most preferred that the hydrocarbon components in the oil remain substantially un-reacted. Preferably the water content in the non-aqueous peroxide oxidant and in the hydrocarbon components, e.g., oil feedstock, should be less than 0.1 wt % and more preferably 0 to 500 ppm. Keeping the amount of water to a minimum helps prevent the formation of solids. The amount of sulfur and/or nitrogen compounds in the oil that must be oxidized in oxidation reactor 3 depends on the end product specifications. For example, to produce commercial diesel with less than 15 ppm sulfur, essentially complete oxidation of sulfur occurs in oxidation reactor 3. To ensure complete oxidation, excess amounts of the oxidant are used. Given that the stoichiometry requires two moles of PAA for each mole of sulfur that is removed and one mole of PAA for each mole of nitrogen that is removed from the oil, about 1.0 to 5.0 times and preferably from 1.5 to 3.0 times the stoichiometric amount of PAA are used for the oxidation. To minimize the amount of oxidation of the hydrocarbons, the conditions of oxidation reactor 3 including, for example, the reaction temperature and the reactor residence time can be adjusted, e.g., lowered. In addition, the PAA concentration in the oxidant can be optimized by adding or removing the acetones in the diluent. The concentration of PAA in the oxidant is 0 to 30 wt % and preferably 5 to 25 wt % and more preferably 5 to 15 wt %. The residence time in oxidation reactor 3 should be 0 to 30 minutes and preferably 1 to 20 minutes depending on the conditions of the reactor, the amounts of sulfur and nitrogen that are present in the feedstock, and the levels of desulfurization and denitrogenation needed.

The oxidized light hydrocarbon oil, such as TLGO, leaving oxidation reactor 3 is fed to acetone stripper 4 via line 19 where acetaldehyde and acetone are removed from the top of the stripper and recycled to oxidant generator 1 through line 14. The acetone-free oil from the bottom of acetone stripper 4 is then fed to sulfone extractor 5 via line 120 where it contacts the AA to extract the sulfones and nitrogen oxides from the oxidized oil. Sulfone extractor 5 can be any continuous multi-stage contacting device, preferably one that is designed for counter-current extraction. Suitable designs include columns with trays, columns with packings, columns with rotating discs, pulse columns, multi-stage mixers/settlers, and any other rotating type contactors. Preferably, the AA contacts the oil in a counter-current fashion to extract the sulfones and nitrogen oxides at a temperature and pressure from 25 to 150° C. and 0 to 100 psig, respectively, more preferably from 30 to 90° C. and 0 to 50 psig, respectively. The AA-to-oil weight ratio in sulfone extractor 5 is from 0.1 to 10, preferably from 0.1 to 5.0.

It should be noted that the sulfones and nitrogen oxides are more polar than the unoxidized sulfur and nitrogen compounds from which they were derived and much more polar than any other hydrocarbon components in the oil. In fact, these oxidized sulfur and nitrogen compounds are orders of magnitude more soluble in the extractive solvents than their non-oxidized counterparts. In general, the polarity of the nitrogen oxides is even higher than that of the sulfones, so the nitrogen oxides are much more easily extracted by the solvent than the sulfones. Therefore, for convenience it is only necessary to consider the sulfones in determining the solvent extraction efficiency.

The raffinate (oil) phase, which comprises mainly oil having reduced amounts of sulfones and nitrogen oxides and minor amounts of AA, is fed to acetic acid stripper 7 via line 22 where the AA is stripped from the oil. Since the boiling point of the oxidized oil is much higher than that of AA and no azeotrope exists in the mixture, the operation of acetic acid stripper 7 is relatively efficient. The stripped AA from the overhead of the stripper is recycled via line 32 as a part of the extractive solvent for sulfone extractor 5. The acid-free, sulfur and nitrogen reduced light hydrocarbon product, such as TLGO, is drawn through line 33 from the bottom of the stripper. It should be noted that with this invention the non-aqueous (water-free) AA is so effective in extracting the sulfones and nitrogen oxides from the oxidized light hydrocarbon in sulfone extractor 5 that no subsequent adsorption step is required in order to meet the product quality requirements. For example, with this novel process, TLGO (diesel) containing 10 to 50 ppm sulfur can be readily produced without an adsorption step. This technique is more efficient than prior art oxidative desulfurization methods described earlier which employ adsorption to remove residual sulfones after the solvent extraction.

The extract (acid) phase from the bottom of sulfone extractor 5 containing mainly AA and minor amounts of sulfones, nitrogen oxides, and oil, is transferred to acetic acid column 6 via line 23. Again, since the boiling points of the sulfones, nitrogen oxides, and oxidized oil are much higher than that of AA and no azeotrope exists in the mixture, the operation of acetic acid column 6 is relatively efficient to recover the AA. The column can be any continuous multi-stage distillation column with various types of trays or packings, operated at a temperature and pressure from 100 to 300° C. and 0.1 to 10 atm, respectively, more preferably from 100 to 200° C. and 0.1 to 5 atm, respectively. The AA is recovered from the overhead stream (line 24) of acetic acid column 6, and a portion is recycled to sulfone extractor 5 via lines 31 and 21 as the extractive solvent and the rest of stream is collected through line 27 as a valuable by-product for chemical and other applications.

As AA is being removed, a very small quantity of a mixture consisting mainly of sulfones and nitrogen oxides and minor amounts of extracted oil develops in the bottom of acetic acid column 6. This mixture is viscous and tends to solidify at lower temperatures. The inventive process not only recovers nearly all the hydrocarbon value from this bottom stream, the process also is able to accommodate this difficult to handle stream. This is achieved by connecting bottom stream 26 to an upstream HDS Unit 8 which treats the oil feed to this process (alternatively, a down-stream HDS unit can be used). HDS Unit 8 can be a conventional (low severity) hydrotreating unit that is designed to treat light hydrocarbon feedstock having a similar boiling range to that of the feedstock (stream 18) that is being treated by this oxidative desulfurization process. As illustrated, a HDS feedstock is fed to HDS Unit 8 through line 130, wherein a split stream is transferred via line 25 to the bottom of acetic acid column 6. Stream 25 can circulate continuously through the bottom of acetic acid column 6 to entrain the sulfones, nitrogen oxides, and the extracted oil from the bottom of acetic acid column 6 in the form of a dilute stream that is recycled back to HDS Unit 8 via line 26. A bottom reboiler in acetic acid column 6 can also serve as a partial preheater for the feedstock of HDS Unit 8.

In order to completely convert the sulfones into $H_2S$ and the corresponding hydrocarbons, instead of the corresponding thiophenic sulfur compounds, which are present before oxidation, the operating conditions of HDS Unit 8 is closely controlled. The unit should be operated at: (1) a temperature from 300 to 500° C. and preferably from 300 to 375° C.; (2) a pressure from 35 to 100 atm and preferably from 35 to 75 atm; (3) a liquid hourly space velocity (LHSV) from 0.5 to 5.0 $hr^{-1}$ and preferably from 1.0 to 2.0 $hr^{-1}$; and (4) a hydrogen-to-oil ratio from 100 to 1,000 $Nm^3/m^3$ and preferably from 300 to 700 $Nm^3/m^3$. The $H_2S$ is removed through stream 28 and the treated feedstock is recovered in stream 29.

Process Flow for Heavy Hydrocarbon Feedstock

Figure 1B:
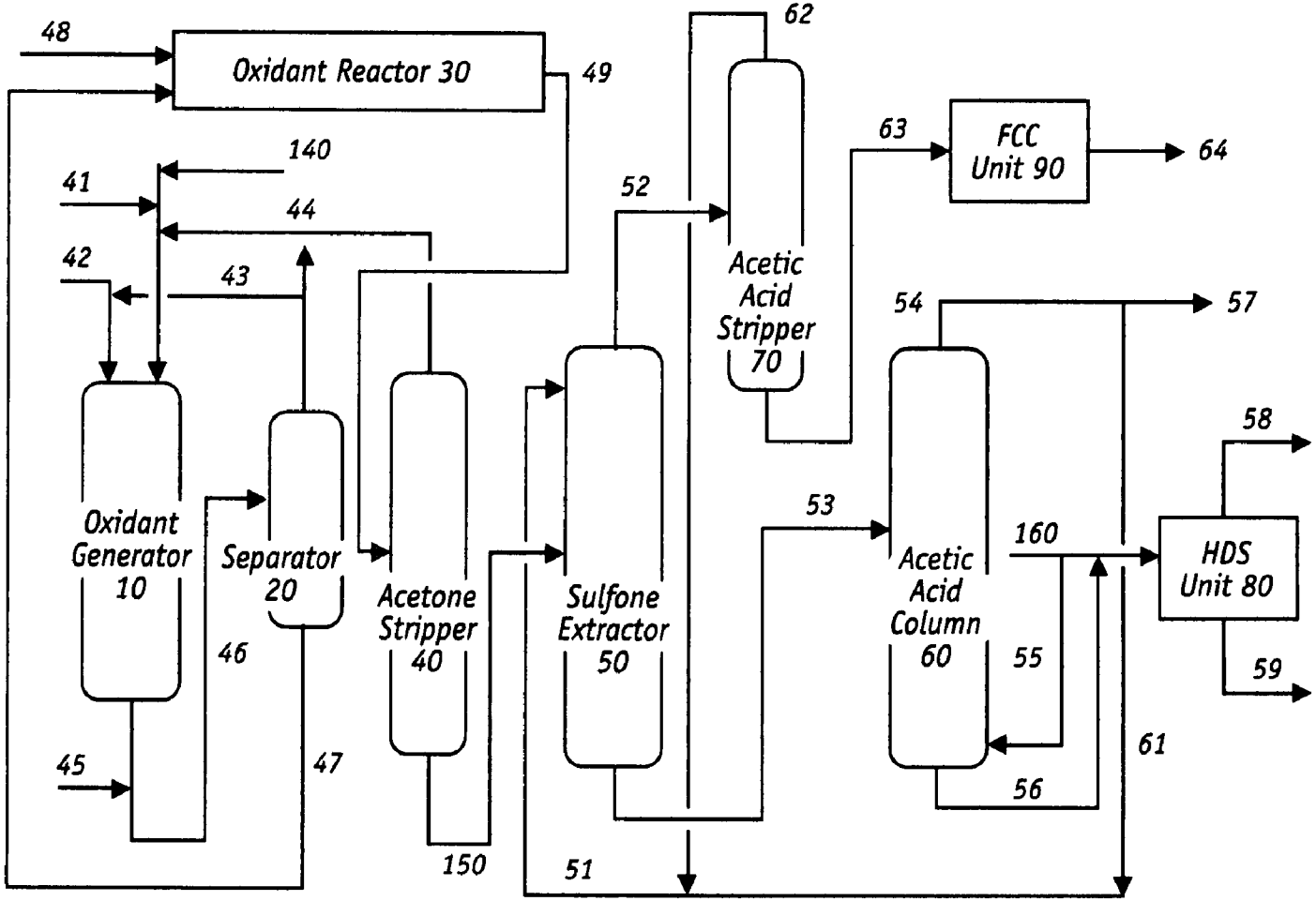

FIG. 1B is a flow diagram of an oxidative desulfurization and denitrogenation process for treating heavy hydrocarbons, such as hydrotreated VGO. The process employs an oxidant generator 10, separator 20, oxidation reactor 30, acetone stripper 40, sulfone extractor 50, acetic acid column 60, acetic acid stripper 70, HDS Unit 80, and FCC Unit 90 as the major components. The process description and operating conditions related to each unit in FIG. 1A for the light hydrocarbon feedstock are essentially applicable to the process units in FIG. 1B for heavy hydrocarbon feedstock. However, the temperature in oxidation reactor 30 should be adjusted to accommodate the more viscous heavy hydrocarbon feed to allow sufficient mixing with the oxidant. The reaction temperature is typically from 30 to 150° C. and preferably from 50 to 100° C. For the same reasons, the extraction temperature in sulfone extractor 50 is also higher, ranging from 50 to 200° C. under pressure from 1 to 10 atm, preferably from 50 to 150° C. under from 1 to 5 atm. The AA-to-oil weight ratio in sulfone extractor 50 is from 0.1 to 10, preferably from 0.1 to 5.0. In this example, the peroxide oxidant is PAA which is prepared by reacting acetylaldehyde with oxygen in acetone. The reaction is catalyzed by iron (III) acetylacetonate (FeAA).

Referring to FIG. 1B, a homogeneous solution of iron (III) acetylacetonate (FeAA), fresh acetaldehyde, and recycled acetone and acetaldehyde from the overhead of acetone stripper 40, are introduced into oxidant generator 10 via lines 140, 41, and 44, respectively. Oxygen is introduced separately into oxidant generator 10 via line 42. Fresh acetone, acetic acid, or the heavy hydrocarbon feed is added to the effluent from oxidant generator 10 through line 45 to adjust the PAA concentration and the combined stream is fed to the separator 20 via line 46 where the light gases are removed as the overhead stream. A portion of the overhead stream is recycled to oxidant generator 10 via line 43.

The gas-free oxidant from separator 20 is fed to oxidation reactor 30 via line 47 to oxidize the heavy hydrocarbon feed, which is introduced to oxidation reactor 30 through line 48. The oxidized heavy hydrocarbon oil exiting oxidation reactor 30 is fed to acetone stripper 40 via line 49 where acetaldehyde and acetone are removed from the top of the stripper and recycled to oxidant generator 10 through line 44. The acetone-free oil from the bottom of acetone stripper 40 is then fed to sulfone extractor 50 via line 150 where it contacts the AA to extract the sulfones and nitrogen oxides from the oxidized oil.

The raffinate (oil) phase is fed to acetic acid stripper 70 via line 52 where the AA is stripped from the oil. Optionally, acetic acid stripper 70 and acetic acid column 60 can be operated under vacuum (typically ranging from 0.1 to 0.9 atm) since the bottom temperatures in these columns are higher than those in FIG. 1A due to the higher boiling ranges of the heavy hydrocarbon. The stripped AA from the overhead of the stripper is recycled via line 62 as a part of the extractive solvent for the sulfone extractor 50. The acid-free, sulfur and nitrogen reduced heavy hydrocarbon product is drawn through line 63 from the bottom of the stripper. This heavy hydrocarbon, e.g., hydrotreated VGO, is a substantially improved feedstock for FCC Unit 90 which yields a product stream 64.

The extract (acid) phase from the bottom of sulfone extractor 50 containing mainly AA and minor amounts of sulfones, nitrogen oxides, and oil is transferred to acetic acid column 60 via line 53. The AA is recovered from the overhead stream (line 54) of acetic acid column 60, and a portion is recycled to sulfone extractor 50 via lines 61 and 51 as the extractive solvent and the rest of stream is collected through line 57. The bottom stream 56 from acetic acid column 60 is connected to an upstream HDS Unit 80 which treats the oil feed to this process (alternatively, a down-stream HDS unit can be used).

Since the molecular weight of the sulfones and nitrogen oxides generated from heavy hydrocarbons are correspondingly higher than those from the light hydrocarbons, the heavier sulfones and nitrogen oxides have a greater tendency to precipitate in the bottom of acetic acid column 60 after AA is removed. To avoid potential problems associated with this precipitation, a split stream from the heavy hydrocarbon, e.g., hydrotreated VGO, feed stream 160 of HDS Unit 80 is transferred via line 55 to the bottom of acetic acid column 60 in order to entrain the sulfones, nitrogen oxides, and the extracted oil from the bottom of acetic acid column 60 in the form of a dilute stream that is recycled back to HDS Unit 80 via line 56. $H_2S$ is removed through stream 58 and treated feedstock is recovered in stream 59. To substantially convert all the sulfones into $H_2S$ and their corresponding hydrocarbons, rather than into their corresponding thiophenic compounds, which exist before oxidation, HDS Unit 80 is preferably operated under the following conditions: (1) temperature from 300 to 500° C., preferably from 300 to 375° C.; (2) pressure of at least 50 to 120 atm, preferably from 50 to 100 atm; (3) liquid hourly space velocity (LHSV) from 0.5 to 5.0 $hr^{-1}$, preferably from 1.0 to 2.0 $hr^{-1}$; and (4) hydrogen-to-oil ratio from 100 to 1,000 $Nm^3/m^3$, preferably from 300 to 700 $Nm^3/m^3$.

Alternative Process Flow for Light Hydrocarbon Feedstock

Figure 2A:
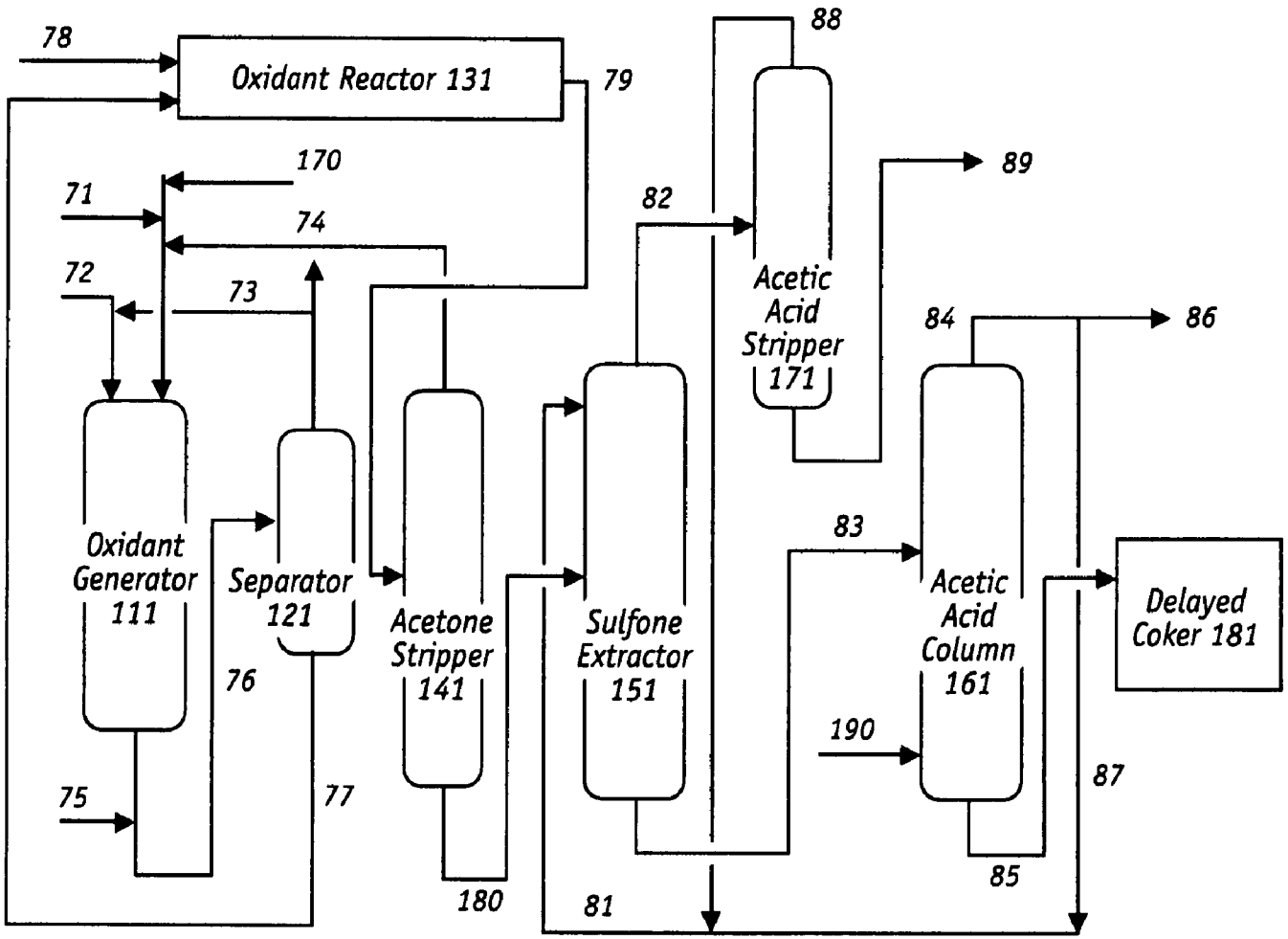
FIGS. 2A and 2B are schematic flow sheets of two alternative desulfurization and denitrogenation processes that are employed for light hydrocarbons and heavy hydrocarbons, respectively.

FIG. 2A is a flow diagram of another oxidative desulfurization and denitrogenation process for treating light hydrocarbons; this process employs a delayed coker. The process employs an oxidant generator 111, separator 121, oxidation reactor 131, acetone stripper 141, sulfone extractor 151, acetic acid column 161, acetic acid stripper 171, and delayed coker 181. The process description and operating conditions related to each unit in FIG. 1A for the light hydrocarbon feedstock are essentially applicable to these process units.

Referring to FIG. 2A, a homogeneous solution of iron (III) acetylacetonate (FeAA), fresh acetaldehyde, and recycled acetone and acetaldehyde from the overhead of acetone stripper 141, are introduced into oxidant generator 111 via lines 170, 71, and 74, respectively. Oxygen is introduced separately into oxidant generator 111 via line 72. Fresh acetone, acetic acid, or the light hydrocarbon feed is added to the effluent from oxidant generator 111 through line 75 to adjust the PAA concentration and the combined stream is fed to the separator 121 via line 76 where the light gases are removed as the overhead stream. A portion of the overhead stream is recycled to oxidant generator 111 via line 73.

The gas-free oxidant from separator 121 is fed to oxidation reactor 131 via line 77 to oxidize the light hydrocarbon feed, which is introduced to oxidation reactor 131 through line 78. The oxidized light hydrocarbon oil exiting oxidation reactor 131 is fed to acetone stripper 141 via line 79 where acetaldehyde and acetone are removed from the top of the stripper and recycled to oxidant generator 111 through line 74. The acetone-free oil from the bottom of acetone stripper 141 is then fed to sulfone extractor 151 via line 180 where it contacts the AA to extract the sulfones and nitrogen oxides from the oxidized oil.

The raffinate (oil) phase is fed to acetic acid stripper 171 via line 82 where the AA is stripped from the oil. The stripped AA from the overhead of the stripper is recycled via line 88 as a part of the extractive solvent for the sulfone extractor 151. The acid-free, sulfur and nitrogen reduced light hydrocarbon product is drawn through line 89 from the bottom of the stripper.

The extract (acid) phase from the bottom of sulfone extractor 151 containing mainly AA and minor amounts of sulfones, nitrogen oxides, and oil is transferred to acetic acid column 161 via line 83. The AA is recovered from the overhead stream (line 84) of acetic acid column 161, and a portion is recycled to sulfone extractor 151 via lines 87 and 81 as the extractive solvent and the rest of stream is collected through line 86. The bottom from acetic acid column 161 which contains the sulfones and nitrogen oxides is treated with delayed coker 181 which heats the oil feed to make lighter components that can then be processed catalytically to form products of higher economic value in order to maximize the yield. To facilitate transfer of the bottom stream into delayed coker 181, an oil diluent, such as the oil feedstock to the oxidation reactor 131, is fed to the bottom of the acetic acid column 161 via line 190 where it is mixed with the sulfones and nitrogen oxides before being drawn into delayed coker via line 85.

Alternative Process Flow for Heavy Hydrocarbon Feedstock

Figure 2B:
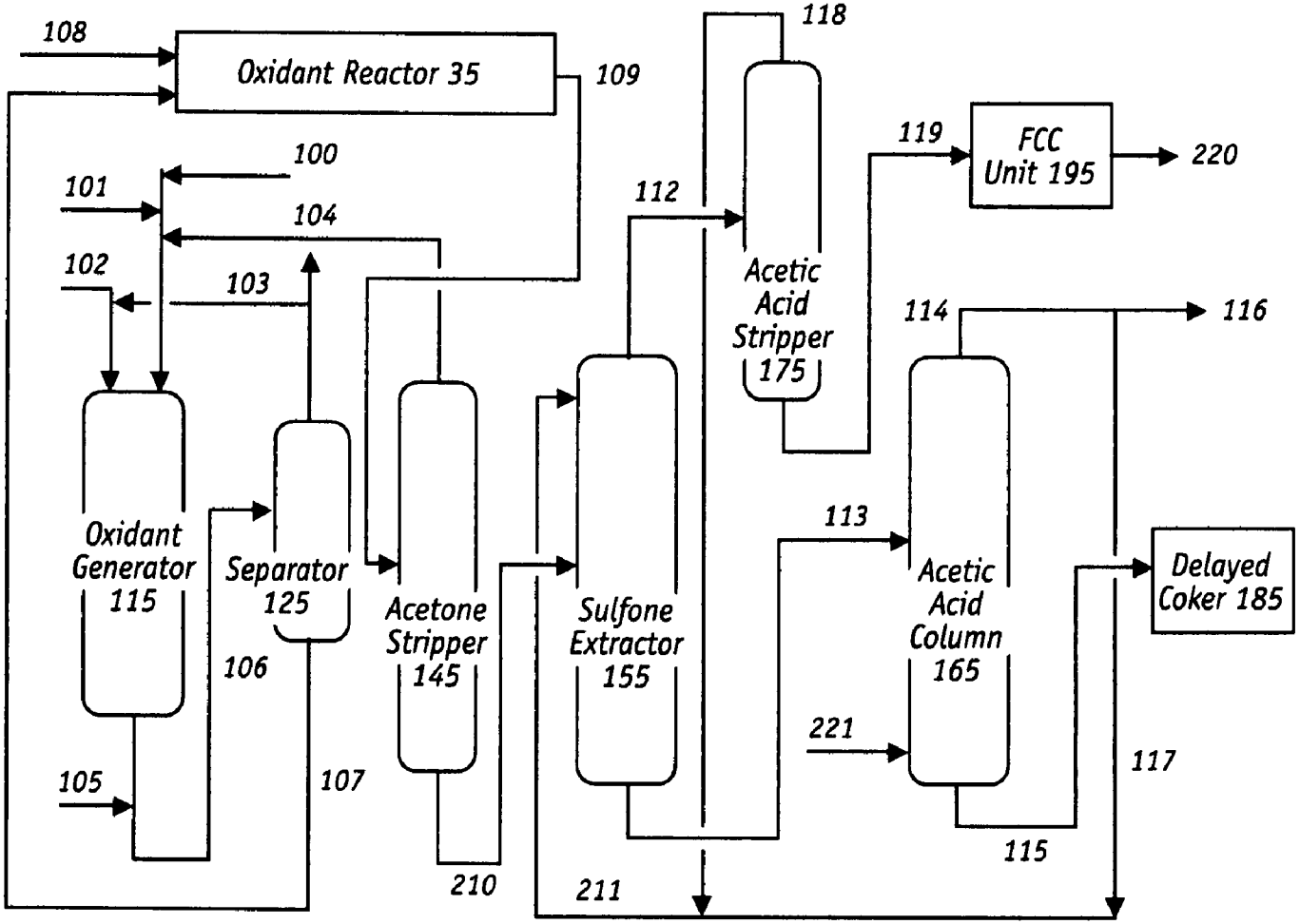
Figure 3A:
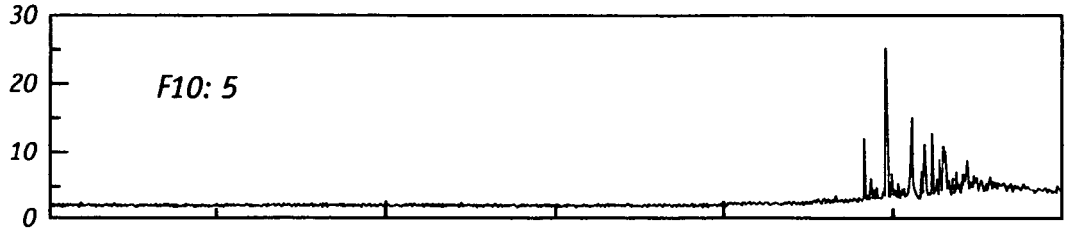
FIGS. 3A-3E are gas chromatography measurements with an atomic emission detector for TLGO oxidation at different PAA concentrations.
Figure 3B:
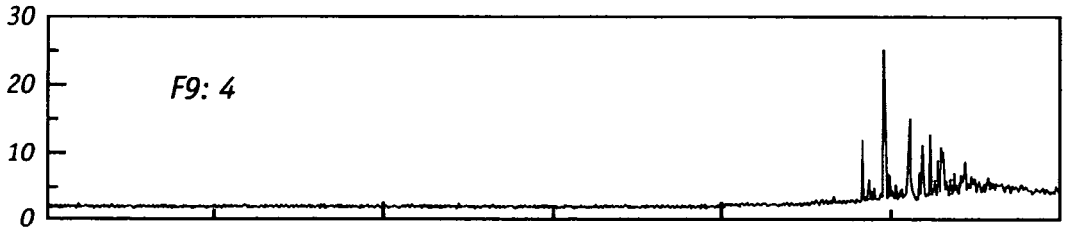
Figure 3C:
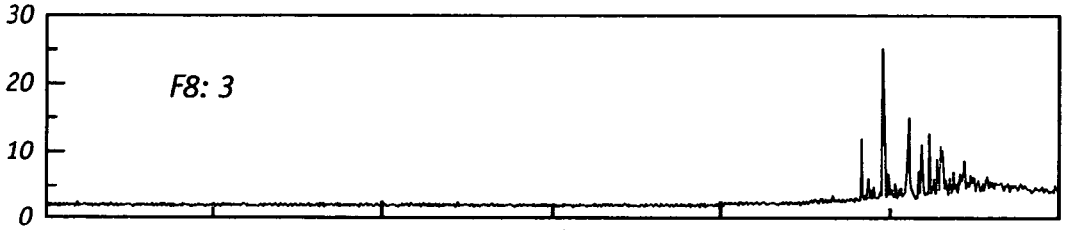
Figure 3D:
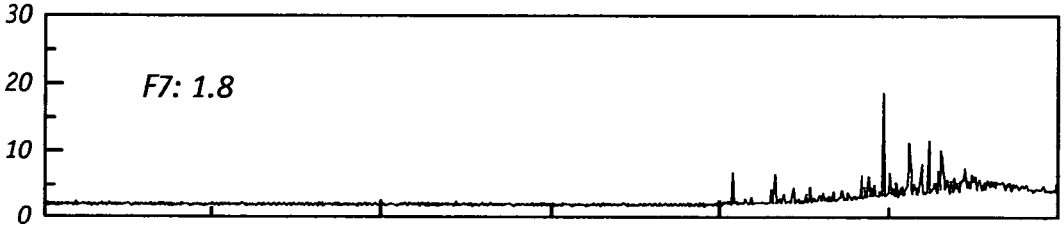
Figure 3E:
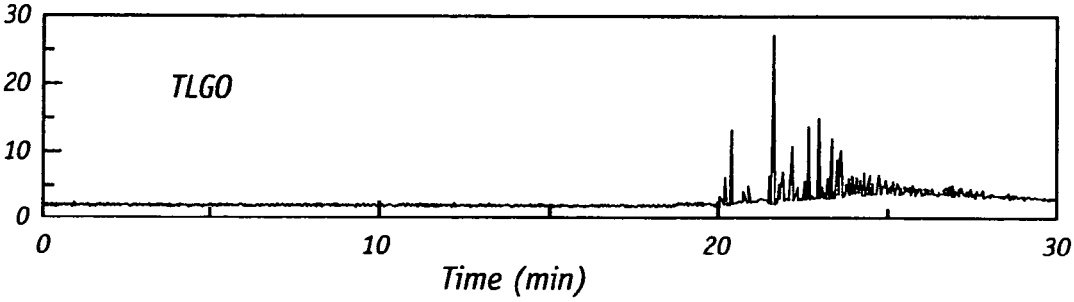

FIG. 2B is a flow diagram of another oxidative desulfurization and denitrogenation process for treating heavy hydrocarbons which also employs a delayed coker. The process employs an oxidant generator 115, separator 125, oxidation reactor 35, acetone stripper 145, sulfone extractor 155, acetic acid column 165, acetic acid stripper 175, delayed coker 185, and FCC Unit 195. The process description and operating conditions related to each unit in FIG. 1B for the heavy hydrocarbon feedstock are essentially applicable to these process units.

Referring to FIG. 2B, a homogeneous solution of iron (III) acetylacetonate (FeAA), fresh acetaldehyde, and recycled acetone and acetaldehyde from the overhead of acetone stripper 145, are introduced into oxidant generator 115 via lines 100, 101, and 104, respectively. Oxygen is introduced separately into oxidant generator 115 via line 102. Fresh acetone, acetic acid, or the heavy hydrocarbon feed is added to the effluent from oxidant generator 115 through line 105 to adjust the PAA concentration and the combined stream is fed to the separator 125 via line 106 where the light gases are removed as the overhead stream. A portion of the overhead stream is recycled to oxidant generator 115 via line 103.

The gas-free oxidant from separator 125 is fed to oxidation reactor 35 via line 107 to oxidize the heavy hydrocarbon feed, which is introduced to oxidation reactor 35 through line 108. The oxidized heavy hydrocarbon oil exiting oxidation reactor 35 is fed to acetone stripper 145 via line 109 where acetaldehyde and acetone are removed from the top of the stripper and recycled to oxidant generator 115 through line 104. The acetone-free oil from the bottom of acetone stripper 145 is then fed to sulfone extractor 155 via line 210 where it contacts the AA to extract the sulfones and nitrogen oxides from the oxidized oil.

The raffinate (oil) phase is fed to acetic acid stripper 175 via line 112 where the AA is stripped from the oil. The stripped AA from the overhead of the stripper is recycled via line 118 as a part of the extractive solvent for the sulfone extractor 155. The acid-free, sulfur and nitrogen reduced heavy hydrocarbon product is drawn through line 119 from the bottom of the stripper and fed into FCC Unit 195 which yields a product stream 220.

The extract (acid) phase from the bottom of sulfone extractor 155 containing mainly AA and minor amounts of sulfones, nitrogen oxides, and oil, is transferred to acetic acid column 165 via line 113. The AA is recovered from the overhead stream (line 114) of acetic acid column 165, and a portion is recycled to sulfone extractor 155 via lines 117 and 211 as the extractive solvent and the rest of stream is collected through line 116. The bottom from acetic acid column 165 which contains the sulfones and nitrogen oxides is treated with delayed coker 185. To facilitate handling, an oil diluent, such as the oil feedstock to the oxidation reactor 35, is fed to the bottom of the acetic acid column 165 via line 221 where it is mixed with the sulfones and nitrogen oxides before being drawn into delayed coker via line 115.

EXAMPLES

The following examples are presented to further illustrate the invention and are not to be considered as limiting the scope of this invention.

Example 1

In this example non-aqueous oxidants suitable for the selective oxidation of sulfur and nitrogen compounds in petroleum oils were prepared. A liquid reactant containing 20 vol. % acetaldehyde (AcH), 80 vol. % acetone, and 7 ppm Fe(III) acetylacetone (FeAA) (catalyst) was fed co-currently with chemical grade oxygen gas to the top of a 0.94 cm diameter jacketed reactor column, which was packed with 20-40 mesh ceramic packing material that was 30 cm in length. Water having a constant temperature was circulated through the reactor jacket to control the reaction temperature. The flow rate of the liquid reactant into the reactor was at 1.5 ml per minute and the flow rate of oxygen gas was at 200 ml per minute. Three experimental runs were carried out at temperatures of 39, 45, and 60° C., under a constant reactor pressure of 6.1 atm. The results are summarized in Table 1.

TABLE 1

| Temperature | Product Composition (wt %) | | | | | | AcH Conversion |
|---|---|---|---|---|---|---|---|
| (° C.) | PAA | AA | $H_2O$ | $CO_2$ | AcH | Acetone | (wt %) |
| 39 | 18.6 | 1.8 | Trace | 0.06 | 5.8 | 73.7 | 67.5 |
| 45 | 21.1 | 4.0 | Trace | 0.09 | 4.0 | 70.8 | 77.5 |
| 60 | 24.0 | 3.9 | 0.2 | 0.5 | 2.6 | 68.8 | 82.0 |

The results indicate that an oxidant containing a high PAA concentration of approximately 20 to 25 wt % can be easily produced at temperatures from 40 to 60° C. under mild pressure. To substantially eliminate water in the oxidant, the reaction temperature should be lower than 45° C. Substantially similar results were obtained when other soluble organoiron compounds, such as FeMK or FeEHO, were used instead of FeAA as the oxidation catalyst.

Example 2

In this example, treated light gas oil (TLGO) was oxidized using different amounts of PAA that was prepared in accordance with Example 1. The TLGO had the following composition and properties:

1. Elemental Composition: carbon 86.0 wt %; hydrogen 12.9 wt %; sulfur 301 ppm; and nitrogen 5.0 ppm.
2. Asphaltene: 0 wt %.
3. Density: 892 (kg/m$^3$) @ 15° C.; 875 (kg/m$^3$)@20° C.
4. Viscosity: 6.5 (mPa-s) @ 20° C.
5. Solid Concentration: 140 ppm.

The TLGO feed was mixed with sufficient amounts of PAA in a glass batch reactor that was equipped with a stirrer. The amounts of PAA (actual PAA) used ranged from 1.1 to 5.0 times the calculated stoichiometric amounts of PAA needed (stoich PAA). The oxidation reaction temperature was 50° C. and the reaction time was 15 minutes. No phase separation or solid precipitation was observed in any of the runs. Thereafter, each oxidized TLGO sample was subject to a one-stage extraction by AA to remove the sulfur which was in the form of sulfones. Each oxidized TLGO sample was mixed with AA at an AA-to-TLGO weight ratio of 1.0. The sulfur content in the oil phase was analyzed and the results are presented in Table 2.

TABLE 2

| Actual PAA/Stoich PAA | Sulfur in Oil phase After Oxidation & Extraction |
|---|---|
| 1.1 | 156 |
| 1.2 | 138 |
| 1.4 | 125 |
| 1.6 | 116 |
| 1.8 | 108 |
| 3.0 | 90 |
| 4.0 | 89 |
| 5.0 | 88 |

The results indicate that AA extraction can reduce the sulfur content in TLGO from the 307 ppm (original TLGO) to approximately 90 ppm in a one-stage extraction. The actual PAA to stoichiometric PAA ratio used in the oxidation should be in the range of 1.8 to 3.0. This amount of PAA should be sufficient to attain almost complete, i.e, 100%, oxidation of the sulfur and nitrogen compounds in the oil.

Example 3

To further demonstrate the effectiveness of PAA in oxidizing sulfur that is present in oil, oxidation experiments were conducted on the same TLGO feed as in Example 2. The oxidation was conducted at 50° C. for 15 minutes, and the ratios of actual added PAA to the stoichiometric required PAA were varied from 1.8 to 5.0 to determine the optimal ratio for complete oxidation of the sulfur and nitrogen compounds in the TLGO. The results of gas chromatography (GC) analysis with an atomic emission detector for the original and treated TLGO are presented in FIGS. 3A-3E. The chromatograms clearly show a complete shift of the sulfur peaks forward the heavy end of the chromatogram when the ratios are higher than 1.8, which means that essentially all the sulfur and nitrogen compounds were converted into sulfones and nitrogen oxides under these conditions.

Example 4

This example demonstrates the effectiveness of the inventive process, which includes oxidation followed by liquid-liquid extraction (LLE), in removing sulfur from light hydrocarbons. Specifically, TLGO with 340 ppm sulfur was oxidized at 60° C. for 30 minutes with PAA as the non-aqueous oxidant wherein the proportion of PAA used was 2.5 times that of the stoichiometric amount. The oxidized TLGO contained 282 ppm sulfur. The sulfur was then extracted from the oxidized TLGO using LLE that was carried out using a 5-stage cross-flow extraction scheme at room temperature, where fresh dry AA was used as the extractive solvent at each stage. For each stage, the oxidized TLGO was mixed with the dry AA at an AA-to-oil weight ratio of 1.0 in a separatory funnel, which was well shaken at room temperature and then allowed to stand during the phase separation. The phases were separated quickly without any difficulty. The mixing and settling procedure was repeated several times to establish the phase equilibrium and then samples were taken from both the oil phase and the solvent phase for total sulfur content analysis. Results of the 5-stage solvent extractions are summarized Table 3.

TABLE 3

| | Sulfur Content (ppm) | | Sulfur Balance for |
|---|---|---|---|
| Extraction Stage | Oil Phase | AA Phase | Each Stage (wt %) |
| 1 | 104 | 184 | 99.9 |
| 2 | 42 | 61 | 99.4 |
| 3 | 21 | 21 | 100.4 |
| 4 | 13 | 8 | 97.5 |
| 5 | 10 | 4 | 98.6 |

The data show that dry AA is indeed excellent for extracting the sulfones (or oxidized sulfur compounds) from the oxidized TLGO in a 5-stage cross-flow extraction scheme that uses fresh solvent at each of the extraction stages. Only 4 stages were needed to reduce the sulfur from 282 to 13 ppm, which is below the 15 ppm level required by the new U.S. standards for diesel (TLGO). Therefore, there is no need to implement any complex and expensive adsorption step for the purpose of further reducing the amount of residual sulfur present in the oil.

Example 5

This example demonstrates the effectiveness of the inventive process, which includes oxidation followed by LLE, in reducing the amounts of sulfur and nitrogen to desirable levels in the heavy hydrocarbon. Specifically, hydrotreated VGO with 2,300 ppm sulfur and 448 ppm nitrogen was oxidized at 60° C. for 30 minutes with PAA as the non-aqueous oxidant wherein the proportion of PAA used was 2.5 times that of the stoichiometric amount. The sulfur and nitrogen oxides were then extracted from the oxidized oil using the dry AA as the extractive solvent. The extraction experiment was carried out using a 3-stage cross-flow extraction scheme at room temperature, wherein fresh dry AA was used as the extractive solvent at each stage. For each stage, the oxidized oil was mixed with the dry AA at an AA-to-oil weight ratio of 1.0 in accordance with the procedure of Example 4. Again, the phases separated quickly without any difficulty. The results of the 3-stage solvent extractions are summarized in Table 4.

TABLE 4

| Extraction | Sulfur Content (ppm) | | Nitrogen Content (ppm) | |
|---|---|---|---|---|
| Stage | Oil Phase | AA Phase | Oil Phase | AA Phase |
| 1 | 1,220 | 800 | 157 | 207 |
| 2 | 820 | 330 | 54 | 45 |
| 3 | 620 | 200 | 44 | 17 |

The data demonstrate that dry AA is excellent for extracting the sulfur and nitrogen oxides from the oxidized VGO in a 3-stage cross-flow extraction scheme using fresh AA at each extraction stage. The sulfur and nitrogen contents of the processed VGO were reduced to 620 and 44 ppm, respectively, which represent a 73% reduction in sulfur and 90% reduction in nitrogen. This example suggests that if this low sulfur VGO is used as feedstock for a conventional fluid catalytic cracking (FCC) unit, the light gases and the naphtha produced from the unit would not require any post desulfurization treatment if used for chemical applications or gasoline blending. In addition, since substantially all the harmful nitrogen (basic nitrogen) that would otherwise inhibit the FCC catalyst are removed from the feedstock, the yield of gasoline and other desirable products should increase because the catalysts are more active.

Example 6

This example demonstrates that the amounts of sulfur and nitrogen oxides can be effectively reduced to desirable levels in an oxidized heavy hydrocarbon, e.g., oxidized hydrotreated VGO, by LLE with dry AA even when employing very low AA-to-oil weight ratios. In particular, a hydrotreated VGO was first oxidized in accordance with the procedures described in Example 5 to yield oxidized oil containing 2,400 ppm sulfur and 509 ppm nitrogen which was then subject to extraction at room temperature. 6-stage and 8-stage cross-flow extraction schemes using 0.50 and 0.25 AA-to-oil ratios, respectively, were employed. Fresh dry AA was used as the extractive solvent at each stage. The results are summarized in Table 5.

TABLE 5

| Extraction Stage | AA-to-VGO Weight Ratio | Sulfur Content in Oil Phase (ppm) | Nitrogen Content in Oil Phase (ppm) |
|---|---|---|---|
| 1 | 0.25 | 1,610 | 193 |
| 2 | 0.25 | 1,280 | 145 |
| 3 | 0.25 | 1,120 | 124 |
| 4 | 0.25 | 952 | 114 |
| 5 | 0.25 | 826 | 98 |
| 6 | 0.25 | 755 | 91 |
| 7 | 0.25 | 680 | 86 |
| 8 | 0.25 | 622 | 82 |
| 1 | 0.50 | 1,220 | 185 |
| 2 | 0.50 | 938 | 131 |
| 3 | 0.50 | 745 | 75 |
| 4 | 0.50 | 603 | 59 |
| 5 | 0.50 | 494 | 54 |
| 6 | 0.50 | 419 | 42 |

The data show that dry AA is effective in extracting sulfur and nitrogen oxides from the oxidized VGO even when the AA-to-oil weight ratio was as low as 0.25 with 8 extraction stages, in which case, the sulfur and nitrogen contents were reduced from 2,400 to 622 ppm, and from 509 to 82 ppm, respectively. With the 6 stage process and a higher AA-to-oil ratio of 0.50, the sulfur and nitrogen contents were reduced from 2,400 to 419 ppm, and from 509 to 42 ppm, respectively. Since AA is vaporized in the inventive process for recycling for reuse as the extraction solvent and for producing a by-product, using a lower AA-to-oil ratio is desirable in order to minimize energy consumption and pumping costs for this circulation step. Usually it is more economical to add more extraction stages to an existing continuous counter-current extractor and to use a lower AA-to-oil ratio than to employ an extractor with fewer stages but one that requires a higher AA-to-oil ratio.

Example 7

This example confirms that performing oxidization and extraction in accordance with the procedure in Example 5 substantially lowers the sulfur and nitrogen contents in hydrotreated VGO and demonstrates that the treated oil also exhibits other improved properties that transform it into a more suitable feedstock for a fluid catalytic cracking unit (FCCU). Specifically, VGO was hydrotreated in 360° C. in a conventional HDS unit and a portion of the hydrotreated oil was then subject to oxidization and solvent extraction in accordance with the procedures of Example 5 to yield oxidized VGO. Both the non-oxidized VGO and oxidized VGO were analyzed for the presence of sulfur, nitrogen and selected organic components and the results are presented in Table 6.

TABLE 6

| | | | | Aromatics* | | |
|---|---|---|---|---|---|---|
| Feedstock | S (ppm) | N (ppm) | Saturates* | 1-ring | 2-ring | $3^+$-ring |
| VGO | 2,300 | 448 | 59.6 | 29.1 | 10.0 | 1.3 |
| Oxidized VGO | 620 | 44 | 68.9 | 24.6 | 5.9 | 0.6 |

*Units in wt %

As is apparent, the inventive oxidation process removed substantial portions of the sulfur and nitrogen but it also increased the amount of saturates and reduced the levels of aromatics. In light of compositional difference, the oxidized VGO is a better feedstock for a FCCU. Laboratory micro-activity tests (MAT) also were conducted on both the hydrotreated VGO (base standard) and the hydrotreated and oxidized/extracted VGO (invention) to determine the crackability of these FCCU feedstocks. Comparative cracking results including the operating conditions and cracking product distribution are summarized in Table 7.

TABLE 7

| Feedstock | Base Standard | Invention |
|---|---|---|
| Cracking Temperature (C.°) | 540 | 540 |
| Catalyst-to-Oil (wt/wt) | 5.0 | 5.0 |
| Conversion (wt %) | 77.91 | 84.38 |
| Yield (wt %) | | |
| Coke | 2.09 | 1.96 |
| Dry Gas | 2.26 | 2.13 |
| Propane | 1.47 | 1.75 |
| Propylene | 7.73 | 9.30 |
| n-Butane | 1.11 | 1.36 |
| Isobutane | 5.43 | 7.19 |
| $C_4$ Olefins | 7.77 | 8.88 |
| Gasoline | 50.05 | 51.82 |
| LCO | 12.20 | 8.98 |
| Bottoms | 9.88 | 6.64 |

The cracking results clearly show that the treatment with the inventive process can substantially improve the cracking conversion and product distribution of the hydrotreated VGO: the cracking conversion substantially increased 6.5%, gasoline increased 1.8%, bottoms decreased 3.2%, propylene increased 1.6%, isobutane increased 1.8%, and $C_4$ olefins increased 1.1%.

Example 8

This example demonstrates the remarkable capability of this inventive process to significantly reduce the sulfur and nitrogen contents in a synthetic crude oil that was generated from Canadian oil sand. The true boiling point distribution of this oil is given in Table 8.

TABLE 8

| % Distilled | Temperature (° C.) |
|---|---|
| 5 | 131 |
| 10 | 196 |
| 20 | 256 |
| 30 | 296 |
| 40 | 325 |
| 50 | 352 |
| 60 | 378 |
| 70 | 407 |
| 80 | 446 |

Figure 4A:
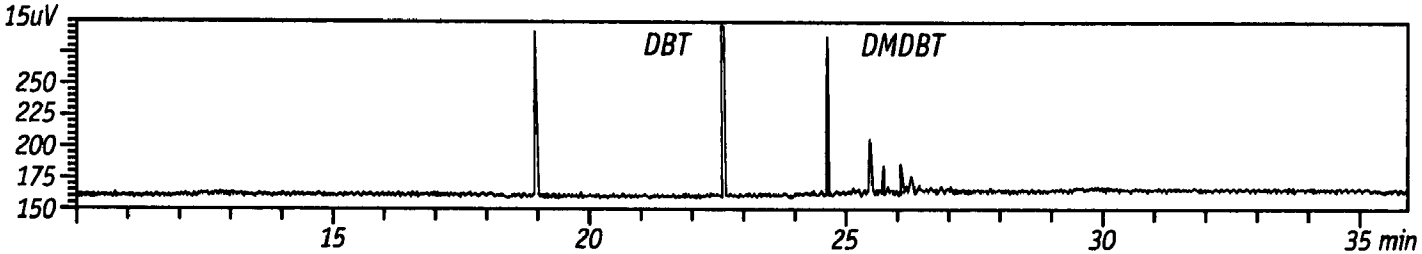
FIGS. 4A-4C are gas chromatography measurements with an atomic emission detector showing the shift in sulfur peaks due to complete oxidation of the sulfur compounds in synthetic crude oil generated from oil sand.
Figure 4B:
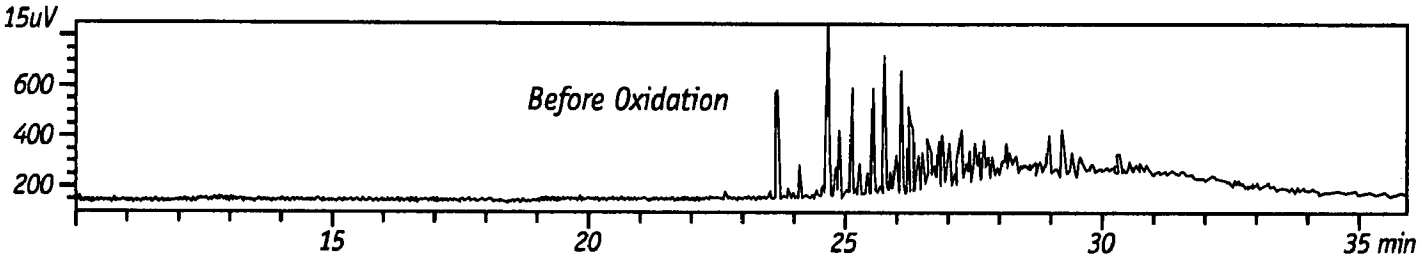
Figure 4C:
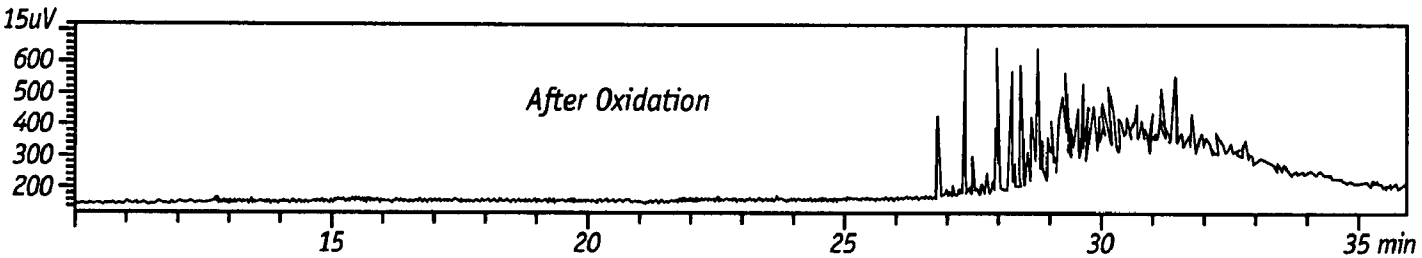

Specifically, synthetic crude containing 1,600 ppm sulfur and 523 ppm nitrogen was oxidized at 60° C. for 30 minutes with PAA as the non-aqueous oxidant where the proportion of PAA used was 2.5 times the stoichiometric amount. No solid formation, phase separation, or precipitation was observed during the oxidation procedure. The sulfur distribution chromatograms before and after the oxidation are presented in FIGS. 4B and 4C, respectively. The sulfur peaks shift clearly to the right (the heavier end), suggest that the sulfur compounds were effectively oxidized into the more polar sulfones, which could be removed from the oil by LLE. The reference locations of dibenzothiophene (DBT) and dimethyl dibenzothiophene (DMDBT) in the chromatogram are shown in FIG. 4A.

The oxidized sulfur and nitrogen were then extracted from the oxidized synthetic crude using dry AA in a 5-stage cross-flow extraction scheme at room temperature where fresh solvent was used at each stage. For each stage, the oxidized synthetic crude was mixed with dry AA to achieve an AA-to-oil weight ratio of 1.0 in accordance with the procedures described in Example 4. Again, the phases separated quickly without any difficulty. Results from the 5-stage solvent extractions are summarized in Table 9.

TABLE 9

| Extraction | Sulfur Content (ppm) | | Nitrogen Content (ppm) | |
|---|---|---|---|---|
| Stage | Oil Phase | AA Phase | Oil Phase | AA Phase |
| 1 | 489 | 872 | 66 | 96 |
| 2 | 224 | 289 | 37 | 36 |
| 3 | 125 | 102 | 26 | 16 |
| 4 | 76 | 32 | 21 | 12 |
| 5 | 56 | 6 | 19 | 9 |

In this 5-stage extraction, the sulfur and nitrogen contents in the oxidized synthetic crude were reduced substantially from 1,600 to 56 ppm, and from 523 to 19 ppm, respectively. Similar results can be achieved in a continuous counter-current extractor having more than 5 extraction stages but which uses a lower AA-to-oil ratio.

Example 9

A feature of the inventive process is that oxidized sulfur (in the form of sulfurs) and nitrogen (nitrogen oxides) are removed from oxidized oil by LLE using AA as the solvent. Unfortunately, entrained hydrocarbons are also removed. It is estimated that the removal of each oxidized sulfur or nitrogen molecule from light hydrocarbon, e.g., diesel, results in an attendant lost of hydrocarbon value that is equivalent to 8 times or more by weight of the sulfur or nitrogen that are removed. The lost is even more pronounced for heavy hydrocarbon oil, such as the hydrotreated VGO, synthetic crude oil from oil sand, and petroleum crude oil. In addition, a small fraction of the most polar hydrocarbon compounds which contain no sulfur or nitrogen is also extracted along with the sulfones and nitrogen oxides thereby further lowering yield. It was discovered experimentally that roughly 9 wt % of hydrotreated VGO was lost through the sulfone stream of the invention.

The following example demonstrates another feature of the invention which is directed to the recovery of the hydrocarbon value that is normally associated with the sulfones and nitrogen oxides and that would otherwise be lost as the sulfones and nitrogen oxides are extracted from the oxidized oil. In addition, the most polar hydrocarbon molecules are also recovered. The approach is to feed the extract (solvent) stream from the LLE after the solvent (AA) is removed to an HDS unit that is operated under specific conditions.

To demonstrate the feasibility of this technique, the VGO sulfones and nitrogen oxides extracted from an oxidized VGO were mixed with a low sulfur diesel, which originally contained only 43 ppm sulfur and no nitrogen. The combined mixture contained 1,080 ppm sulfur and 66.8 ppm nitrogen. Both the low sulfur diesel (base) and the VGO sulfones/nitrogen oxides added diesel (invention) were hydrotreated in a conventional pilot size HDS unit packed with HDS catalyst KF757H supplied by Nippon Ketjen. The hydrotreating conditions were: LHSV at 1.56 $hr^{-1}$; $H_2$/Oil at 459 $NM^3/M^3$; pressure at 52.7 atm (absolute); and temperature at 370° C. Liquid samples were taken from the reactor effluent at 24 and 48 hours on-stream times. In all cases, no sulfur or nitrogen was detected in the hydrotreated diesel. This result suggests that the VGO sulfones and nitrogen oxides can be removed in a HDS unit if operated under defined parameters.

To confirm the above results, the VGO sulfones and nitrogen oxides were also added to a heavy diesel fraction, with the combined mixture contained 1.47 wt % sulfur and 239 ppm nitrogen. Again, both the base diesel and the sulfones and nitrogen oxides added diesel were treated in a conventional pilot size HDS unit that was packed with the same catalyst and operated under the same HDS conditions, except that the temperature was 340° C. Liquid samples were taken from the reactor effluent at 60 and 72 hours on-stream times. There are essentially no differences in sulfur and nitrogen contents in the HDS effluents between the base case and the sulfones added case. The results are presented in Table 10.

TABLE 10

| Feed-On-Stream | Base Case Oil | | Base Case Oil + VGO Sulfones | |
|---|---|---|---|---|
| Time (Hours) | S (ppm) | N (ppm) | S (ppm) | N (ppm) |
| 60 | 706 | 60.5 | 700 | 62.6 |
| 72 | 651 | 51.4 | 656 | 62.4 |

Again, the above results indicate that the VGO sulfones and nitrogen oxides are treatable in a conventional HDS which is operated under specified conditions. This technique allows the hydrocarbon value in the sulfone stream of the inventive process to be essentially completely recoverable through recycling the stream to the HDS unit so long as the unit is operated under effective hydrocarbon value recovery conditions which typically include: (1) a temperature of at least 300 up to 500° C. and preferably from 300 to 375° C., (2) a pressure of at least 35 up to 100 atm (absolute) and preferably from 35 to 75 atm (absolute), (3) liquid hourly space velocity (LHSV) from 0.5 to 5.0 $hr^{-1}$, preferably from 1.0 to 2.0 $hr^{-1}$, and (4) a hydrogen-to-oil ratio from 100 to 1,000 $Nm^3/m^3$, preferably from 300 to 700 $Nm^3/m^3$.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A continuous process for removing sulfur-containing compounds and nitrogen-containing compounds from a liquid hydrocarbon feedstock that comprises the steps of:

(a) contacting the hydrocarbon feedstock with a non-aqueous oxidant that contains a peroxy organic acid to selectively oxidize the sulfur-containing compounds into sulfones and the nitrogen-containing compounds into nitrogen oxides whereby an organic acid by-product is produced when the sulfur-containing compounds and the nitrogen-containing compounds are oxidized; and (b) removing the sulfones and nitrogen oxides with an extraction solvent comprising organic acid by-product that is produced in step (a).

2. The process of claim 1 wherein step (a) comprises contacting the hydrocarbon feedstock in an oxidation reactor and step (b) comprises the steps of:

(i) removing ketones and aldehyde to generate a ketone/aldehyde-free effluent stream and a ketone/aldehyde stream;

(ii) contacting the ketone/aldehyde-free effluent stream with the organic acid by-product to extract sulfones and nitrogen oxides from the ketone/aldehyde-free effluent steam whereby (1) an extractor raffinate phase is generated and (2) an extract phase containing organic acid by-product, sulfones, nitrogen oxides, and a minor amount of polar hydrocarbons is generated;

(iii) stripping organic acid by-product from the extractor raffinate phase to generate a desulfurized and denitrogenated hydrocarbon product and recycling at least a part of the stripped organic acid by-product for reuse in step (ii);

(iv) recovering organic acid by-product from the extract phase to yield an oxidized products stream that contains sulfones, nitrogen oxides, and polar hydrocarbons and recycling at least a part of the organic acid by-product for reuse in step (ii); and (v) treating the oxidized products stream to recover hydrocarbons.

3. The process of claim 2 wherein step (v) comprises treating the oxidized products stream in a hydrodesulfurization (HDS) unit or in a coker unit.

4. The process of claim 1 wherein the hydrocarbon feedstock is light hydrocarbons.

5. The process of claim 1 wherein the non-aqueous oxidant is prepared by catalytic oxidation of an aldehyde with molecular oxygen.

6. The process of claim 5 wherein the aldehyde is acetaldehyde.

7. The process of claim 1 wherein the non-aqueous oxidant is prepared by oxidizing an organic acid with an aqueous hydrogen peroxide solution to produce an peroxy organic acid in solution and thereafter dehydrating the solution to yield the peroxy organic acid.

8. The process of claim 7 wherein the organic acid is acetic acid.

9. The process of claim 1 wherein the non-aqueous oxidant is prepared by mixing acetaldehyde (AcH) in ketone to form a mixture and then oxidizing the AcH with molecular oxygen to produce a mixture that comprises up to about 30 wt % peracetic acid.

10. The process of claim 9 wherein step (a) comprises contacting the AcH in an oxidant generator and wherein the oxidant generator continuously contacts the acetaldehyde and the soluble organoiron (III) homogenous catalyst with gaseous oxygen.

11. The process of claim 10 wherein the ketone is acetone and step (a) comprises contacting the hydrocarbon feedstock in an oxidation reactor to generate a reactor effluent and step (b) comprises feeding the reactor effluent to a stripping column or evaporator to vaporize acetone and acetaldehyde to generate an acetone/acetaldehyde-free stream and a stream, that contains a mixture of acetone and acetaldehyde, which is recycled to the oxidant generator.

12. The process of claim 1 wherein sulfur and nitrogen in the liquid hydrocarbon feedstock are oxidized by the non-aqueous oxidant that comprises peracetic acid in an acetone medium and the oxidation occurs at a reaction temperature and pressure 0 to 150° C. and from 0 to 200 psig, respectively.

13. The process of claim 12 wherein 1.0 to 5.0 times the theoretical stoichiometric amount of oxidant, which is calculated on the basis of sulfones and nitrogen oxides formation, are used in step (a) to oxidize substantially all of the sulfur-containing compounds and nitrogen-containing compounds in the liquid hydrocarbon feedstock.

14. The process of claim 12 wherein the water content in each of the non-aqueous oxidant and the liquid hydrocarbon feedstock is less than 0.1 wt % which prevents solid precipitations and phase separation in the process, and prevents azeotropic formation between acetic acid and water, caused by the presence of excessive water.

15. The process of claim 1 wherein no oxidation catalyst is used in step (a).

16. The process of claim 2 wherein step (ii) comprises feeding the acetone/acetaldehyde-free effluent stream to a liquid-liquid extractor to remove the sulfones and nitrogen oxides with the organic acid by-product that comprises acetic acid that serves as an extractive solvent.

17. The process of claim 16 wherein the organic acid by-product is anhydrous acetic acid containing less than 0.1 wt % water.

18. The process of claim 16 wherein the liquid-liquid extractor operates at a pressure range of 0 to 100 psig and a temperature range of 25 to 150° C.

19. The process of claim 2 wherein the organic acid by-product in the extractor raffinate phase in step (ii) is acetic acid and the acetic acid is recovered as an overhead product of a stripping column used in step (iii) wherein at least a part of the stripped acetic acid is recycled for reuse as a solvent in step (ii).

20. The process of claim 2 wherein the extractor raffinate phase in step (ii) comprises treated light gas oil (TLGO) and TLGO is recovered as a bottom product of a stripping column used in step (iii) that achieves a sulfur content of 0 to 50 ppm, without the need of a subsequent adsorption step.

21. The process of claim 2 wherein the organic acid by-product in the extractor extract phase in step (ii) is acetic acid and the acetic acid is recovered as an overhead product of a distillation column used in step (iv) wherein at least a part of the recovered acetic acid is recycled for reuse as a solvent in step (ii).

22. The process of claim 3 wherein step (v) comprises treating the oxidized products stream in an HDS unit and a split stream from a feed stream of the HDS unit is continuously circulated through the bottom of a distillation column used in step (iv) to remove the sulfones, nitrogen oxides, and the polar hydrocarbons from the bottom of the distillation column to the HDS unit.

23. The process of claim 22 wherein the continuously circulating stream through the bottom of the distillation column in step (iv) to the HDS contains 0 to 10 wt % of the sulfones and nitrogen oxides that are hydrotreated in the HDS unit to recover hydrocarbons that are associated with the sulfones, nitrogen oxides, and the polar hydrocarbons.

24. The process of claim 3 wherein step (v) comprises treating the oxidized products stream in an HDS unit which is operated at a temperature of at least 300 to 500° C., at a pressure of at least 35 to 100 atm (absolute), at liquid hourly space velocity (LHSV) of 0.5 to 5.0 $hr^{-1}$, and at hydrogen-to-oil ratio of 100 to 1,000 $Nm^3/m^3$ to ensure the substantial conversion of sulfones into the corresponding hydrocarbons and to ensure substantial conversion of nitrogen oxides into the corresponding hydrocarbons.

25. The process of claim 3 wherein step (v) comprises treating the oxidized products stream in an HDS unit which is operated at a temperature of at least 300 to 375° C., at a pressure of at least 35 to 75 atm (absolute), at liquid hourly space velocity (LHSV) of 1.0 to 2.0 $hr^{-1}$, and at hydrogen-to-oil ratio of 300 to 700 $Nm^3/m^3$.

26. A continuous process for removing sulfur-containing compounds and nitrogen-containing compounds from a liquid hydrocarbon feedstock that comprises the steps of:

(a) contacting the hydrocarbon feedstock with a non-aqueous oxidant that contains a peroxy organic acid to selectively oxidize the sulfur-containing compounds into sulfones and the nitrogen-containing compounds into nitrogen oxides whereby an organic acid by-product is produced when the sulfur-containing compounds and the nitrogen-containing compounds are oxidized without requiring an oxidation catalyst; and (b) removing the sulfones and nitrogen oxides with an extraction solvent comprising the organic acid by-product in step (a).

27. The process of claim 26 wherein step (a) comprises contacting the hydrocarbon feedstock in an oxidation reactor and step (b) comprises the steps of:

(i) removing ketones, and aldehyde to generate a ketone/aldehyde-free effluent stream and a ketone/aldehyde stream;

(ii) contacting the ketone/aldehyde-free effluent stream with the organic acid by-product to extract the sulfones and nitrogen oxides from the ketone/aldehyde-free effluent steam whereby (1) an extractor raffinate phase is generated and (2) an extract phase containing the organic acid by-product, sulfones, nitrogen oxides, and a minor amount of polar hydrocarbons is generated;

(iii) stripping organic acid by-product from the extractor raffinate phase to generate a desulfurized and denitrogenated hydrocarbon product and recycling at least a part of the stripped organic acid by-product for reuse in step (ii);

(iv) recovering organic acid by-product from the extract phase to yield an oxidized products stream that contains sulfones, nitrogen oxides, and polar hydrocarbons and recycling at least a part of the organic acid by-product for reuse in step (ii); and (v) treating the oxidized products stream to recover hydrocarbons.

28. The process of claim 27 wherein step (v) comprises treating the oxidized products stream in a hydrodesulfurization (HDS) unit or in a coker unit.

29. The process of claim 26 wherein the hydrocarbon feedstock is heavy hydrocarbons.

30. The process of claim 29 wherein the hydrocarbon feedstock is selected from the group consisting of hydrotreated and non-hydrotreated vacuum gas oil (VGO), petroleum crude oil, synthetic crude oil from oil sand, and residual oil.

31. The process of claim 26 wherein the non-aqueous oxidant is prepared by catalytic oxidation of an aldehyde with molecular oxygen.

32. The process of claim 31 wherein the aldehyde is acetaldehyde.

33. The process of claim 26 wherein the non-aqueous oxidant is prepared by oxidizing an organic acid with an aqueous hydrogen peroxide solution to produce an peroxy organic acid in solution and thereafter dehydrating the solution to yield the peroxy organic acid.

34. The process of claim 33 wherein the organic acid is acetic acid.

35. The process of claim 26 wherein the non-aqueous oxidant is prepared by mixing acetaldehyde (AcH) in ketone to form a mixture and then oxidizing the AcH with molecular oxygen to produce a mixture that comprises up to about 30 wt % peracetic acid.

36. The process of claim 35 wherein step (a) comprises contacting the AcH in an oxidant generator and wherein the oxidant generator continuously contacts the AcH and the soluble organoiron (III) homogenous catalyst with gaseous oxygen.

37. The process of claim 36 wherein the ketone is acetone and step (a) comprises contacting the hydrocarbon feedstock in an oxidation reactor to generate a reactor effluent and step (b) comprises feeding the reactor effluent to a stripping column or evaporator to vaporize acetone and acetaldehyde to generate an acetone/acetaldehyde-free stream and a stream, that contains a mixture of acetone and acetaldehyde, which is recycled to the oxidant generator.

38. The process of claim 26 wherein sulfur and nitrogen in the liquid hydrocarbon feedstock are oxidized by the non-aqueous oxidant that comprises peracetic acid in an acetone medium and the oxidation occurs at a reaction temperature and pressure 0 to 150° C. and from 0 to 200 psig, respectively.

39. The process of claim 38 wherein 1.0 to 5.0 times the theoretical stoichiometric amount of oxidant, which is calculated on the basis of sulfones and nitrogen oxides formation, are used in step (a) to oxidize at least a portion of the sulfur-containing compounds and nitrogen-containing compounds in the liquid hydrocarbon feedstock.

40. The process of claim 38 wherein the water content in each of the non-aqueous oxidant and the liquid hydrocarbon feedstock is less than 0.1 wt % which prevents solid precipitations and phase separation in the process, and prevents azeotropic formation between acetic acid and water, caused by the presence of excessive water.

41. The process of claim 27 wherein step (ii) comprises feeding the acetone/acetaldehyde-free effluent stream to a liquid-liquid extractor to extract the sulfones and nitrogen oxides with the organic acid by-product that comprises acetic acid that serves as an extractive solvent.

42. The process of claim 41 wherein the organic acid by-product comprises anhydrous acetic acid containing less than 0.1 wt % water.

43. The process of claim 41 wherein the liquid-liquid extractor operates at a pressure range of 0 to 100 psig and a temperature range of 25 to 150° C.

44. The process of claim 27 wherein the organic acid by-product in the extractor raffinate phase in step (ii) is acetic acid and the acetic acid is recovered as an overhead product of a stripping column used in step (iii) wherein at least a part of the stripped acetic acid is recycled for reuse as a solvent in step (ii).

45. The process of claim 27 wherein an acid-free, desulfurized and denitrogenated heavy hydrocarbon feedstock is recovered as a bottom product of a stripping column used in step (iii) that achieves substantially reduced sulfur and nitrogen contents, without the need for a subsequent adsorption step.

46. The process of claim 45 wherein the desulfurized and denitrogenated heavy hydrocarbon feedstock is generated from hydrotreated VGO and is fed to a fluid catalytic cracker unit (FCCU) to produce products with substantially improved conversion and product distribution.

47. The process of claim 46 wherein light gases and naphtha produced from the FCCU contain substantially reduced sulfur and nitrogen which do not require further desulfurization or denitrogenation treatment for use chemical applications or fuel blending.

48. The process of claim 27 wherein the organic acid by-product in the extractor extract phase in step (ii) is acetic acid and the acetic acid is recovered as an overhead product of a distillation column used in step (iv) wherein at least a part of the recovered acetic acid is recycled for reuse as the solvent in step (ii).

49. The process of claim 27 step (v) comprises treating the oxidized products stream in an HDS unit wherein a split stream from a feed stream of the HDS unit in step (v) is continuously circulated through a bottom of a distillation column used in step (iv) to remove the sulfones, nitrogen oxides, and the polar hydrocarbons from the bottom of the distillation column to the HDS unit.

50. The process of claim 49 wherein the continuously circulating stream through the bottom of the distillation column in step (iv) to the HDS contains 0 to 10 wt % of the sulfones and nitrogen oxides that are hydrotreated in the HDS unit to recover hydrocarbons that are associated with the sulfones, nitrogen oxides, and the polar hydrocarbons.

51. The process of claim 27 wherein the HDS unit in step (v) is operated at a temperature of at least 300 to 500° C., at a pressure of at least 35 to 100 atm (absolute), at liquid hourly space velocity (LHSV) of 0.5 to 5.0 $hr^{-1}$, and at hydrogen-to-oil ratio of 100 to 1,000 $Nm^3/m^3$ to ensure substantial conversion of sulfones into the corresponding hydrocarbons and to ensure substantial conversion of nitrogen oxides into the corresponding hydrocarbons.

52. The process of claim 27 wherein the HDS unit in step (v) is operated at a temperature of at least 300 to 375° C., at a pressure of at least 35 to 75 atm (absolute), at liquid hourly space velocity (LHSV) of 1.0 to 2.0 $hr^{-1}$, and at hydrogen-to-oil ratio of 300 to 700 $Nm^3/m^3$.

* * * * *